US007958920B1

(12) United States Patent
Olsson

(10) Patent No.: US 7,958,920 B1
(45) Date of Patent: Jun. 14, 2011

(54) COMPACT REUSABLE SHOPPING BAG ASSEMBLY

(75) Inventor: Tiffany E. Olsson, Eden Prairie, MN (US)

(73) Assignee: Tiffany E. Olsson, Bloomington, MN (US)

( * ) Notice: Subject to any disclaimer, the term of this patent is extended or adjusted under 35 U.S.C. 154(b) by 974 days.

(21) Appl. No.: 11/880,430

(22) Filed: Jul. 23, 2007

(51) Int. Cl.
*A45C 1/02* (2006.01)
*B65D 30/00* (2006.01)

(52) U.S. Cl. ..... 150/112; 383/4; 383/38; 383/40; 383/2; 150/113; 150/117; 190/109; 190/110; 190/111

(58) Field of Classification Search ..... 383/4, 38–40, 383/2; 150/112, 113, 116, 117; 190/109–111
See application file for complete search history.

(56) References Cited

U.S. PATENT DOCUMENTS

| | | | | | |
|---|---|---|---|---|---|
| 1,341,404 | A | * | 5/1920 | Wisniewska | 383/99 |
| 1,463,729 | A | * | 7/1923 | Stember | 150/101 |
| 1,537,956 | A | | 5/1925 | McNally | |
| 1,604,658 | A | | 10/1926 | Post | |
| 1,606,107 | A | | 11/1926 | Simms | |
| 1,672,322 | A | * | 6/1928 | Keiser et al. | 383/119 |
| D136,560 | S | * | 10/1943 | Lebaigue | D3/303 |
| 2,332,757 | A | * | 10/1943 | Roth | 190/111 |
| 2,654,527 | A | | 10/1953 | Geckler et al. | |
| 2,671,486 | A | | 3/1954 | Shaw | |
| RE25,826 | E | * | 8/1965 | Ward | 190/108 |
| 3,512,700 | A | | 5/1970 | Evans et al. | |
| 4,090,542 | A | * | 5/1978 | Hacker, Jr. | 383/29 |
| 4,153,146 | A | | 5/1979 | Patton et al. | |
| 4,782,874 | A | | 11/1988 | Chartier | |
| 5,046,860 | A | * | 9/1991 | Brennan | 383/38 |
| D328,550 | S | * | 8/1992 | Mogil et al. | D7/605 |
| 5,182,895 | A | | 2/1993 | Lugo | |
| 5,213,418 | A | | 5/1993 | Dancy et al. | |
| 5,490,619 | A | | 2/1996 | Boyar | |
| 5,531,366 | A | | 7/1996 | Strom | |
| D380,607 | S | * | 7/1997 | Leben | D3/243 |
| 5,797,529 | A | | 8/1998 | Lavine | |
| 6,149,003 | A | * | 11/2000 | Day | 206/449 |
| 6,152,202 | A | | 11/2000 | Magid | |
| 6,206,224 | B1 | | 3/2001 | Potts et al. | |
| 7,293,649 | B2 | * | 11/2007 | Gelphman et al. | 206/320 |
| 7,699,524 | B2 | * | 4/2010 | Moore, Sr. | 383/13 |

(Continued)

FOREIGN PATENT DOCUMENTS

JP 3-143409 * 6/1991

(Continued)

OTHER PUBLICATIONS

Questions About Your Community : Shopping Bags : Paper or Plastic or . . . ? US Environmental Protection Agency, Region 1 Jun. 2006.
Pressure Builds to Ban Palstic Bags in Stores New York Times, Jul. 2007.

(Continued)

*Primary Examiner* — Tri M Mai
(74) *Attorney, Agent, or Firm* — Richard John Bartz

(57) ABSTRACT

A compact, user-friendly and reusable shopping bag assembly has a pocket with a cavity having a top opening accommodating a plurality of reusable auxiliary shopping bags. A primary shopping bag is hinged to the pocket for movement between a compact folded position adjacent a side of the pocket to an unfolded position for holding merchandise. A panel assembly having pockets for holding printed materials are attached to the front of the pocket.

33 Claims, 30 Drawing Sheets

U.S. PATENT DOCUMENTS

2004/0129357 A1* 7/2004 Soto ..... 150/112
2006/0233465 A1* 10/2006 Moore, Sr. ..... 383/6

FOREIGN PATENT DOCUMENTS

JP 8-80214 * 3/1996

OTHER PUBLICATIONS

Retailers Push Reusable Bags to save Money, Environment USA Today Sep. 2007.

Paper, Plastic or Prada Time Aug. 13, 2007.

* cited by examiner

COMPACT REUSABLE SHOPPING BAG ASSEMBLY

FIELD OF THE INVENTION

The invention is in the field of reusable shopping bags having a primary bag and plurality of auxiliary bags.

BACKGROUND OF THE INVENTION

Retail and grocery stores provide their customers with paper and plastic bags to accommodate merchandise and facilitate transport of the merchandise to a remote location, such as a home. After use, some of these bags are recycled into paper and plastic products. However, the majority of the paper and plastic bags are discarded garbage that end up in landfills, in incinerators, or as windblown litter causing widespread pollution. Conventional plastic bags made from petroleum are not biodegradable and have caused detrimental effects to the environment. Plastic bags contain hazardous inks that can rinse off and seep with water into the ground water, streams and lakes. Paper bags made from renewable wood resources consume these resources and require considerable amounts of energy to manufacture and distribute. It is recognized that paper and plastic bags have numerous negative environmental consequences. Environment and conservation minded persons, organizations, businesses, and governments in the United States and abroad have created a movement to encourage or to require shoppers to use reusable shopping bags instead of the conventional paper and plastic bags. Examples of U.S. patents describing reusable shopping bags include the following U.S. patents.

W. H. Post in U.S. Pat. No. 1,604,658 discloses a reusable single shopping bag and hand bag usable in a folded condition as a hand bag and in an unfolded condition as a shopping bag. When the bag is in the folded condition, a first flap and a releasable fastener retain the bag in its folded condition. A second flap extended between a pair of handles and a releasable fastener partly close the open end of the bag in the unfolded condition. E. W. Simms in U.S. Pat. No. 1,606,107 discloses a single reusable bag for use as a hand bag or article carrier. The bag when in its folded and unfolded condition has a pair of loop handles used to hand carry the bag. A flap holds the bag in its folded condition and partly closes the open top of the bag in its unfolded condition.

E. W. Geckler et al in U.S. Pat. No. 2,654,527 discloses a single paper bag having two compartments formed from a single sheet of paper. The bag has a main body with an open top chamber to accommodate merchandise and a separate pocket coextensive in length with the main body for holding additional merchandise.

T. P. Brennan in U.S. Pat. No. 5,046,860 discloses a reusable shopping bag assembly having a primary bag and a plurality of rolled auxiliary bags. As shown in FIG. 7, the primary bag has a pair of loop handles used to hand carry the bag. A pocket for storing auxiliary bags is stitched to the center of the exterior side wall of the primary bag. A cover attached to the exterior side wall of the primary bag closes the open top of the pocket.

N. R. Lugo in U.S. Pat. No. 5,182,895 discloses an independent shopping bag carrier accommodating reusable folded side-by-side shopping bags. Each shopping bag is color coded to identify the size of the bag. The color coding of each bag is visible through the top opening of the carrier to enable the shopper to select a bag for accommodating merchandise.

K. L. Potts et al in U.S. Pat. No. 6,206,224 discloses a shopping caddy system to be used in an automobile. The caddy has a plurality of rectangular compartments that hold reusable collapsible bags upright during automobile transport. The outside wall of the bag has a slip pocket. A pair of loop handles secured to the side walls of the bag are used to hand carry the bag and place it in the caddy.

SUMMARY OF THE INVENTION

The compact reusable shopping bag assembly of the invention is an alternative to point of sale paper and plastic bags currently used in retail and grocery stores. The compact reusable bag assembly provides a practical, easy to use and convenient way of reducing the use of plastic and paper shopping bags. The bag assembly provides a way to carry several reusable bags together in an appealing compact form, and provides reusable shopping bags that are easy to open and fold up, convenient to carry, and durable in construction with environmentally compatible materials that preclude tearing and breaking apart. The compact reusable bag assembly has a pocket with a pocket cavity having a top opening for storing one or more folded, secondary or auxiliary bags. A primary bag connected to the pocket is folded adjacent one side of the pocket and retained in a compact folded condition with releasable retainers. When these retainers are released, the primary bag is easy to unfold to an open condition to accommodate purchased items. The primary bag has a flat bottom wall with an edge hinged to the pocket which allows for the pivotal movement of the bottom wall and folding and unfolding of the primary bag. When the primary bag is in the unfolded open condition, the bottom wall of the pocket and the bottom wall of the primary bag are horizontally aligned and concurrently engage in a support to stabilize the shopping bag assembly. The shopper has the option to use only the primary bag without interference from the pocket and auxiliary bags stored in the pocket cavity. One or more auxiliary bags can be removed from the pocket cavity and unfolded to an open condition for use to accommodate additional purchased items. Handles secured to an auxiliary bag are used to manually carry the pocket, folded primary bag and auxiliary bags. An additional feature of the shopping bag assembly is a panel assembly used to hold sheet materials that include shopping lists.

One preferred embodiment of the compact reusable shopping bag assembly has a pocket joined to a primary shopping bag made from environmentally compatible materials, such as jute, seaweed, canvas, hemp fibers, recyclable polypropylene or recycled materials. Other materials can be used that are strong and durable and allow repeated use over a long period of time. The pocket has a generally flat front wall and a rear wall laterally spaced from the front wall providing a pocket cavity with a top opening for holding a plurality of folded reusable auxiliary bags. A bottom wall and upright side walls joined to the front and rear walls maintains the three-dimensional shape of the pocket. An upright partition located in the pocket cavity joined to the bottom and side walls divides the pocket cavity into two compartments. Printed sheet materials, such as magazines, store flyers, and brochures can be retained in one compartment. The folded reusable auxiliary bags are storable in the other compartment. One reusable auxiliary bag has a pair of handles extended upwardly from the pocket usable to manually carry the pocket, primary folded bag and folded auxiliary bags. A flap secured to the top middle of the rear wall extends under the arched handles over the top opening of the pocket cavity. A releasable fastener retains the flap to the front wall of the pocket to secure and contain the reusable auxiliary bags in the pocket cavity while carrying the bag assembly in its folded compact form. When the flap is released from the pocket, the reusable auxiliary bags can be removed from the pocket cavity and unfolded to open conditions for accommodating items. The reusable bag assembly is a relatively narrow rectangular bag assembly that provides the convenience of several durable reusable shopping bags in a compact and appealing form. In use a person has the option to use the primary bag while the auxiliary bags are stored in the pocket cavity of the pocket without the inconvenience of an independent carrier. A panel assembly having a fabric panel and a transparent panel is secured to the front wall of the pocket for holding coupons and a shopping list. The shopping list is placed behind the transparent panel where it can be viewed in a protected location. The panel assembly includes an elastic band extended across the transparent panel to retain a shopping list sheet on top of the transparent panel where it can be observed by a person. A pen holder is provided to store a writing instrument to check items off the shopping list The compact shopping bag assembly of the invention is appealing and user-friendly to encourage persons to use reusable shopping bags, and alters the consumer habit of using conventional paper and plastic shopping bags. Many persons, including family shoppers, use a number of paper or plastic bags to transport purchased items. The shopping bag assembly provides a way to carry numerous reusable bags in a single, appealing, compact form. The reusable bag assembly provides a person the option of using one shopping bag while additional shopping bags are inconspicuously stored in the pocket cavity of the pocket without interference of an independent carrier. Additional reusable bags can be readily removed from the pocket cavity if required to accommodate purchased items. The shopping bag assembly includes an auxiliary feature of a panel assembly for holding shopping lists, coupons, and printed materials that provides a handy and organized system and style of shopping. The panel assembly is convenient to use, saves time and effort, and adds to a person's shopping ease and comfort. The compact reusable shopping bag assembly is a handy and viable alternative to conventional paper and plastic shopping bags providing persons with a way to conserve and preserve our natural resources.

DESCRIPTION OF THE INVENTION

In the following detailed descriptions of the compact reusable shopping bag assembly and reusable bags, reference is made to the accompanying drawing that form a part hereof, and in which are shown, by way of illustration, specific embodiments in which the invention may be practiced. It is to be understood that other embodiments may be utilized and structural changes may be made without departing from the scope of the present invention. The compact reusable shopping bag assembly is herein described as used in a shopping environment. The reusable bag assembly can have uses other than shopping.

Figure 1:
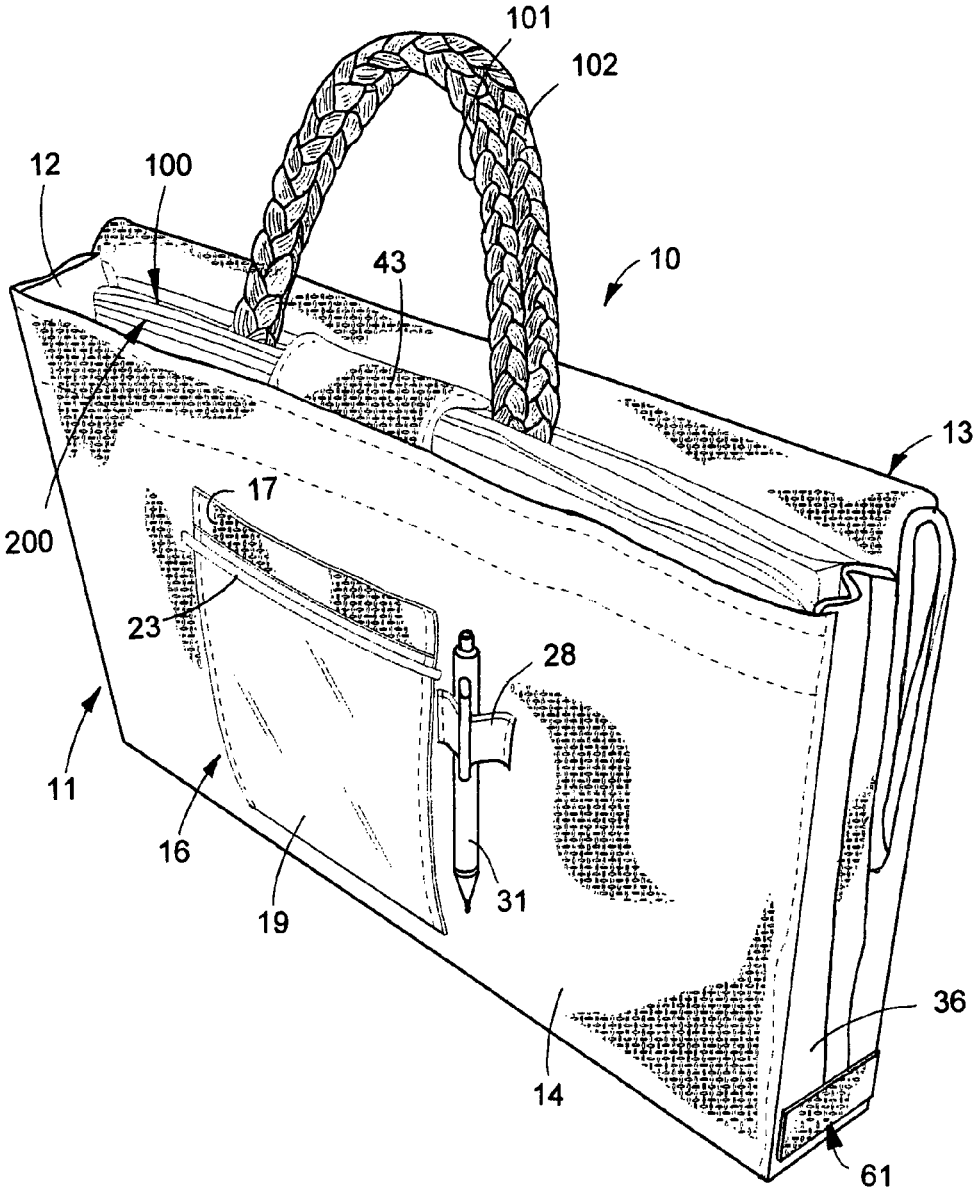
FIG. 1 is a perspective view of the compact reusable shopping bag assembly of the invention.
Figure 2:
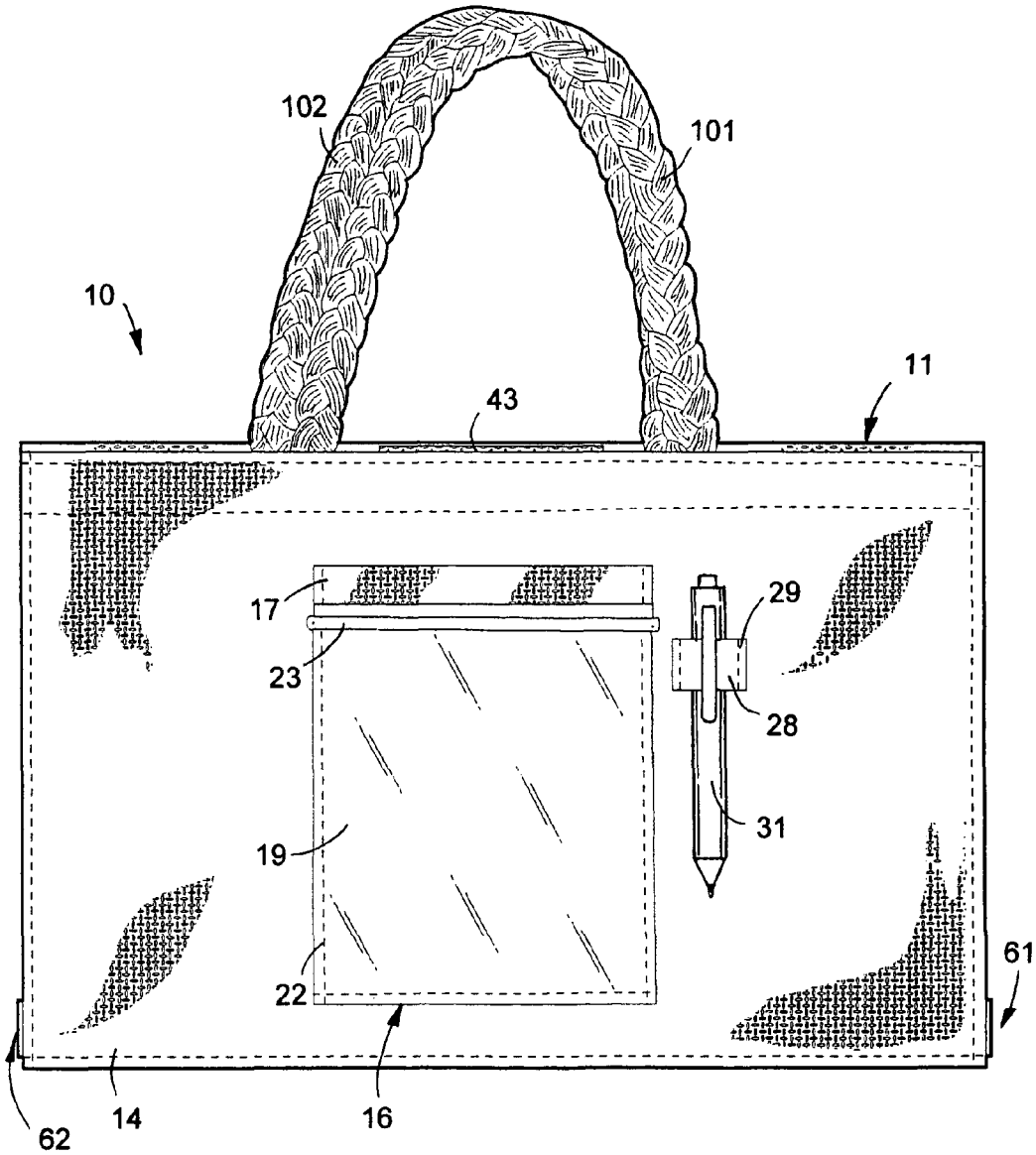
FIG. 2 is a front elevational view thereof.
Figure 38:
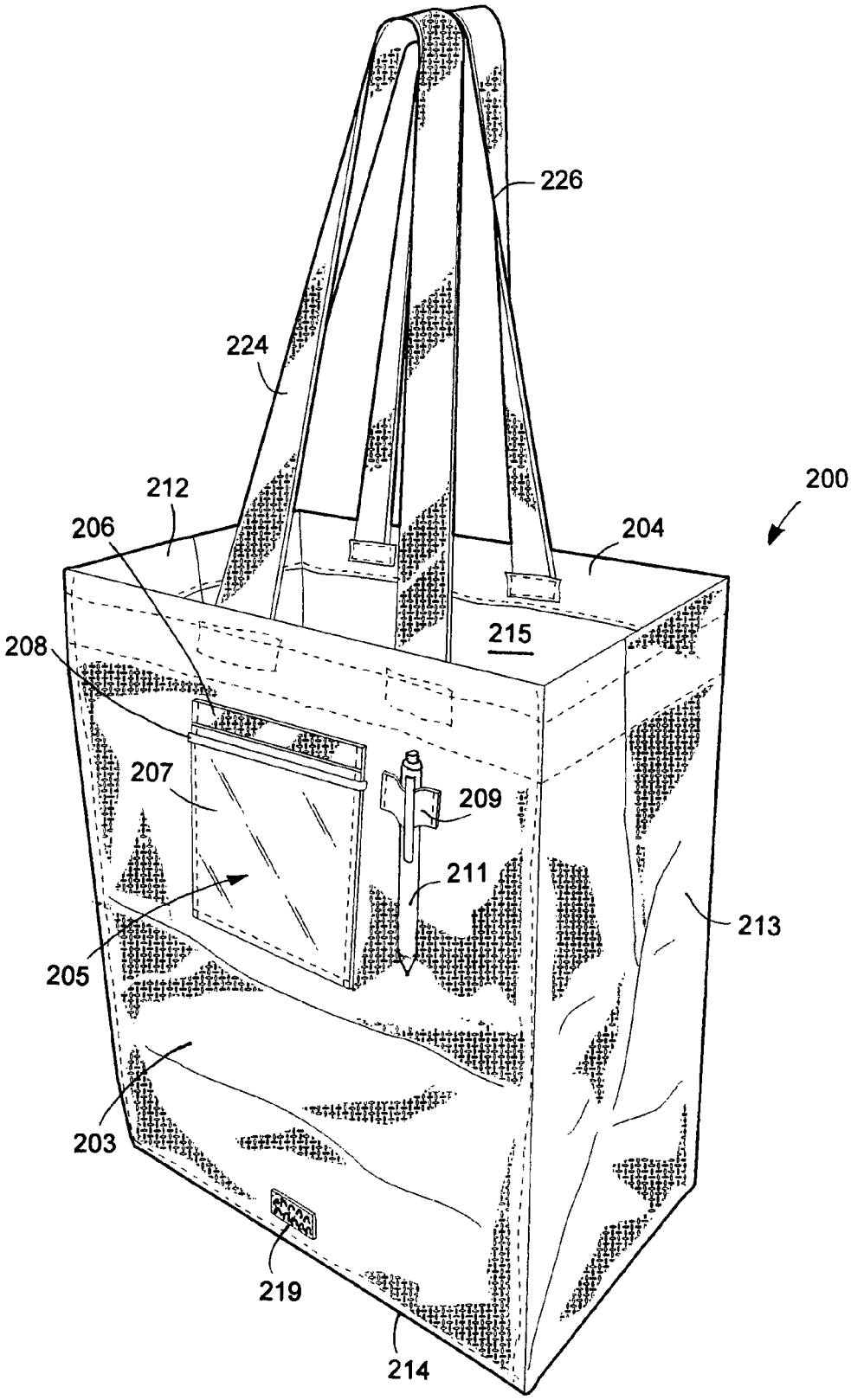
FIG. 38 is a perspective view of an open unfolded second reusable auxiliary bag usable with the compact reusable shopping bag assembly of FIG. 1.
Figure 39:
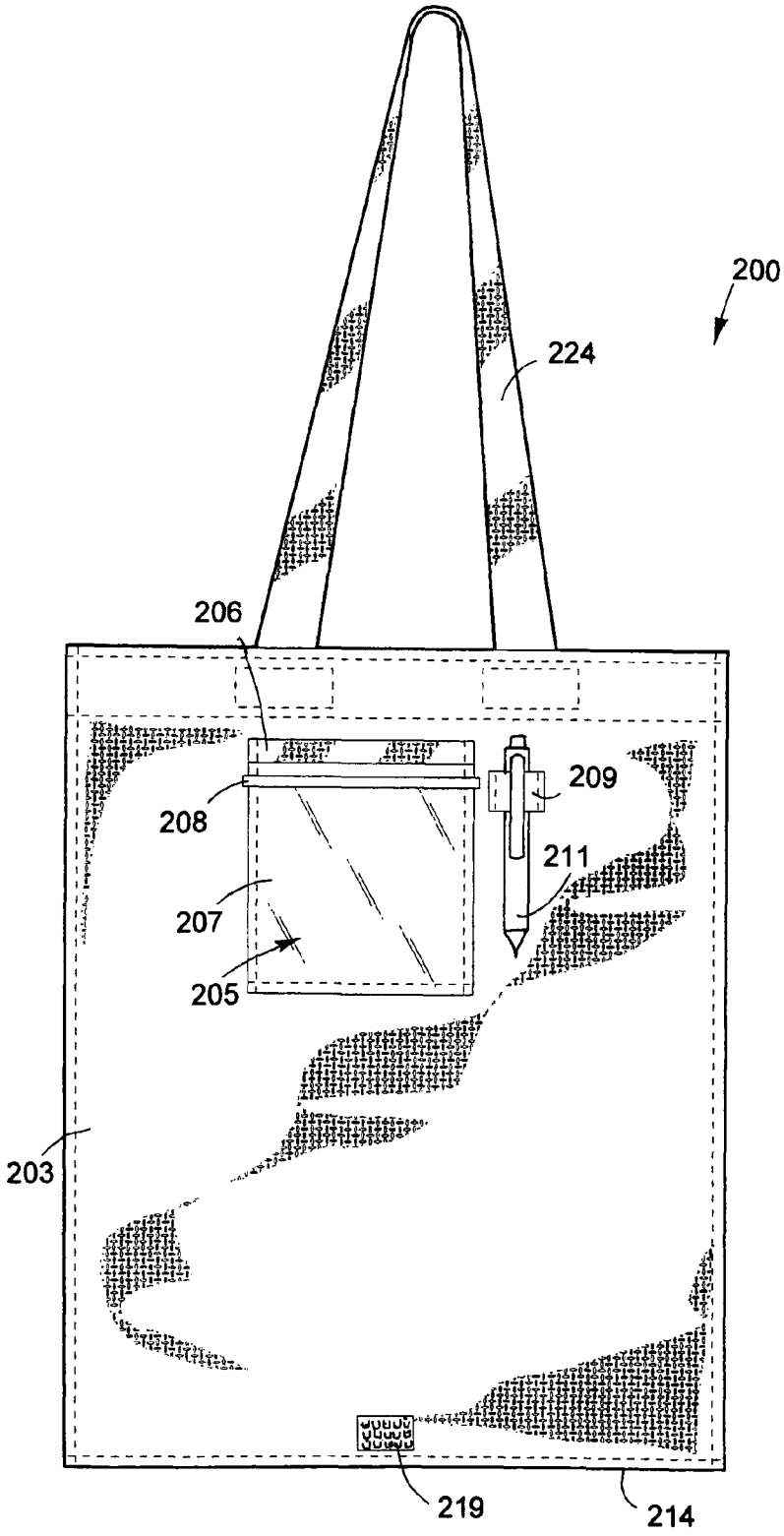
FIG. 39 is a front elevational view of the reusable bag of FIG. 38.
Figure 40:
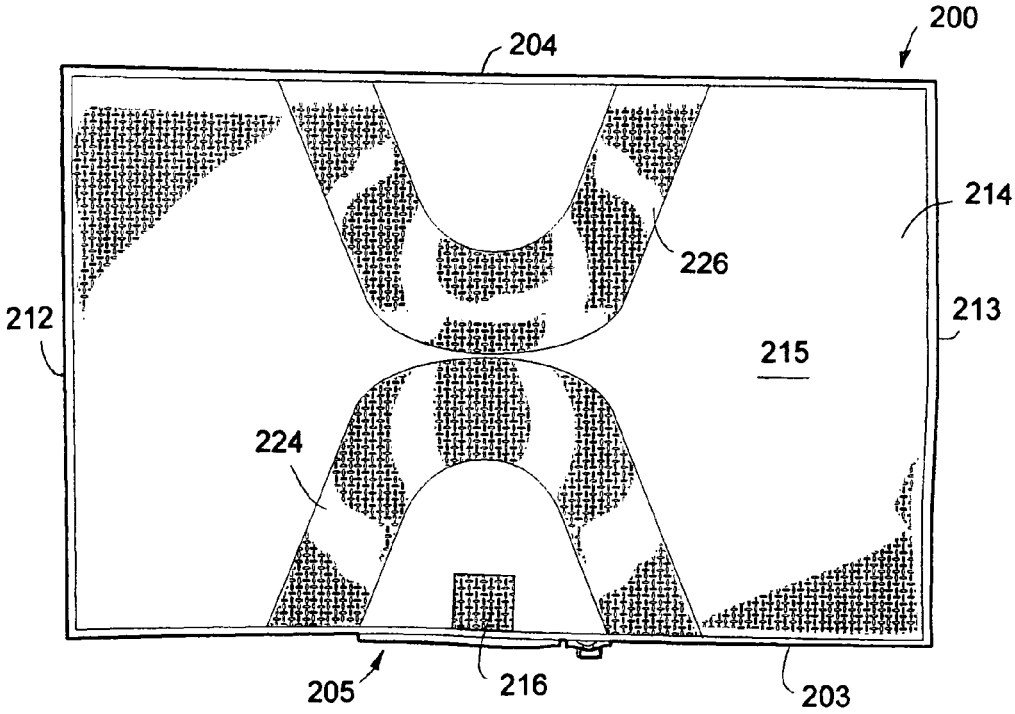
FIG. 40 is a top plan view of the reusable bag of FIG. 38.
Figure 41:
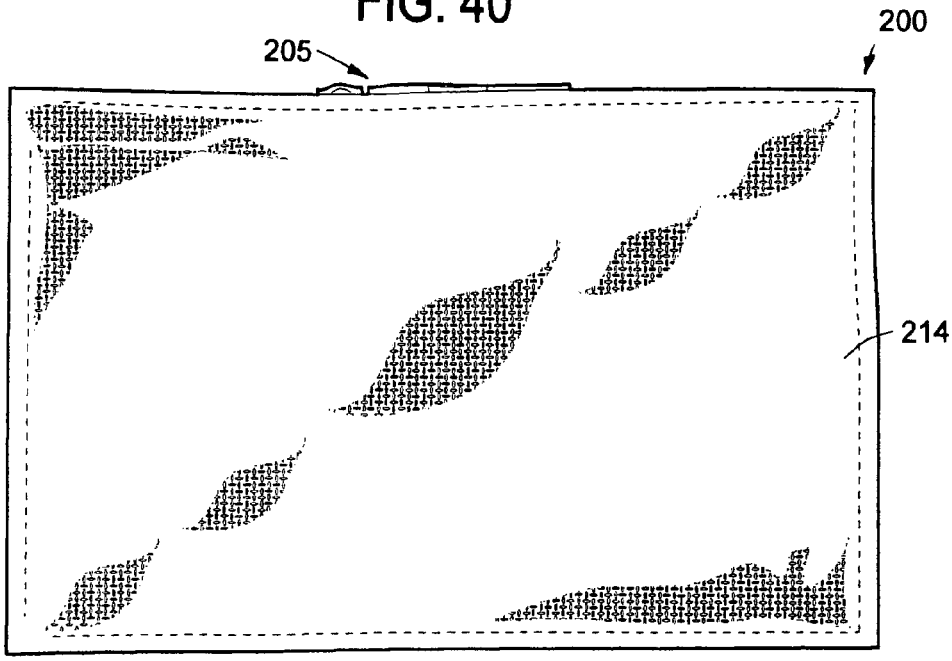
FIG. 41 is a bottom plan view of the reusable bag of FIG. 38.
Figure 42:
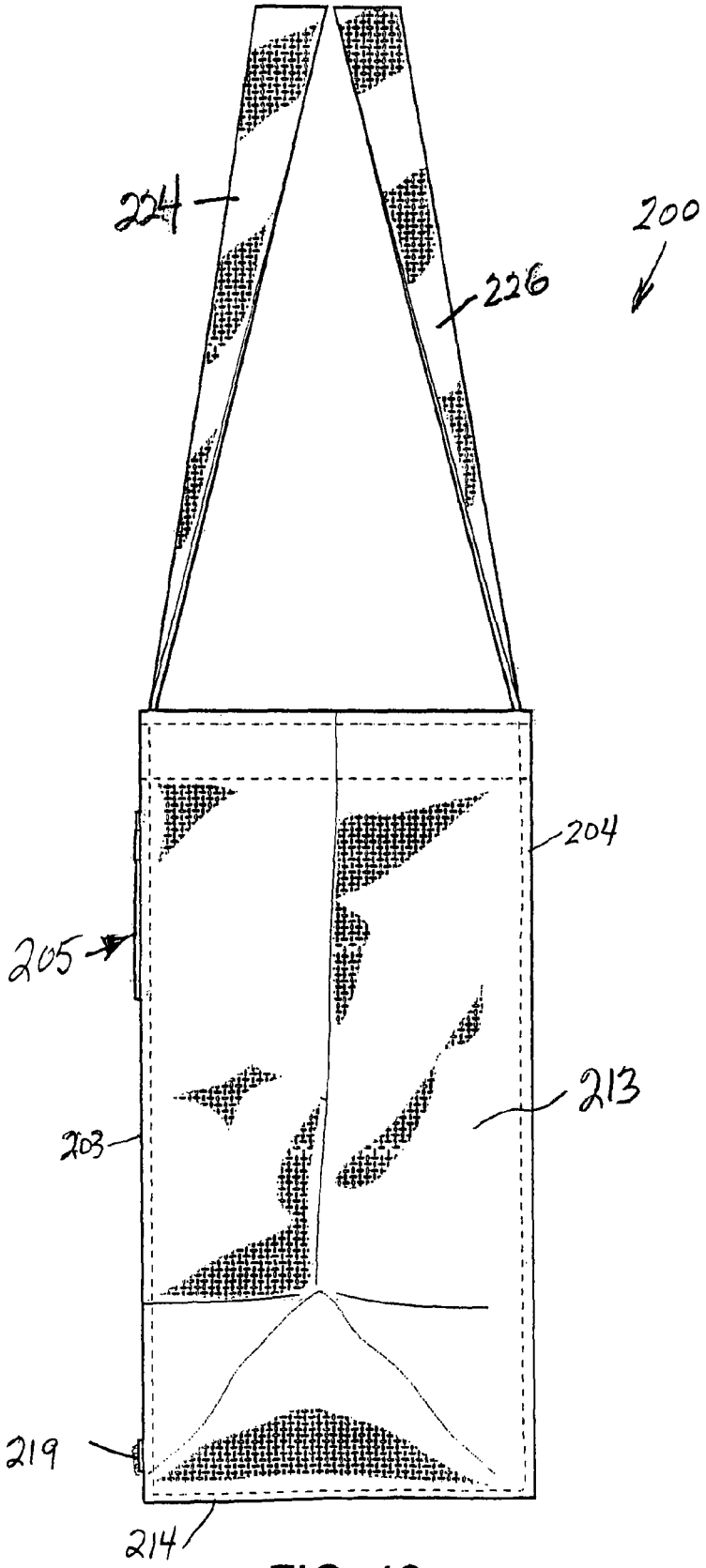
FIG. 42 is a side elevational view of the reusable bag of FIG. 38.

A compact reusable shopping bag assembly 10, shown in FIGS. 1 and 2, is a portable bag assembly usable as an alternative to conventional paper and plastic bags used in retail and grocery stores to package and transport merchandise and food products. The use of reusable bag assembly 10 reduces the number of paper and plastic bags that are detrimental to the environment. Bag assembly 10 has a pocket 11 combined with a primary shopping bag 13. Pocket 11 has a pocket cavity 12 with top opening for storing printed materials and one or more second or auxiliary reusable shopping bags 100 and 200. One reusable auxiliary bag 100 has a pair of arched handles 101 and 102 extended upwardly from pocket 11 usable to manually carry bag assembly 10. Reusable auxiliary bag 200 has handles 224 and 226, shown as shoulder straps in FIG. 38, that can be used as an alternative to manually carry reusable bag assembly 10. A primary shopping bag 13 is folded parallel to the back of pocket 11 providing bag assembly 10 with a generally flat configuration which is easy and convenient for a person to hand carry. Pocket 11 and primary shopping bag 13 are made from environmentally compatible materials, such as jute, canvas, bamboo, straw, seaweed, hemp fabric, recyclable polypropylene or recycled materials. Reusable bag assembly 10 can be made of other materials that are strong and durable and allow repeated use over a long period of time.

Figure 3:
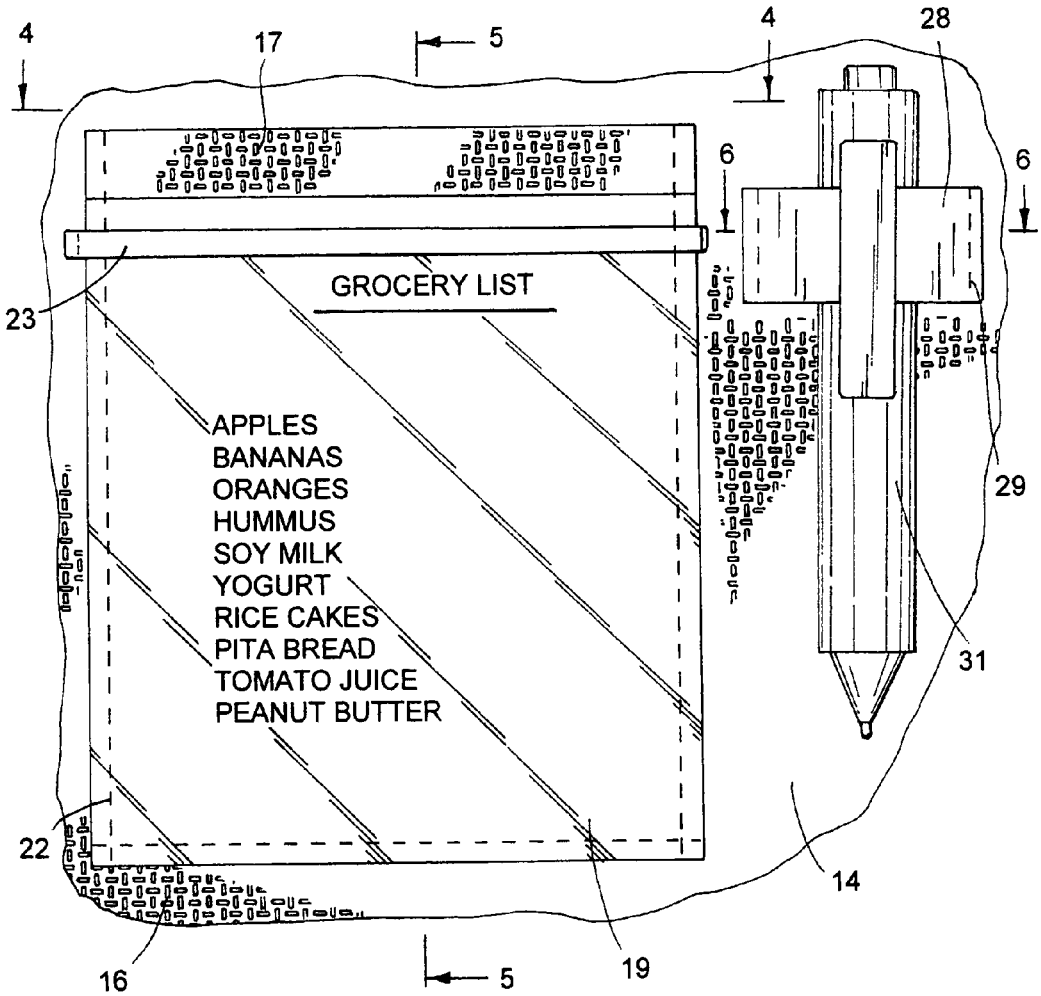
FIG. 3 is an enlarged front elevational view of the middle section of the front of the compact reusable shopping bag assembly showing the panel assembly for holding printed sheet materials.
Figure 4:
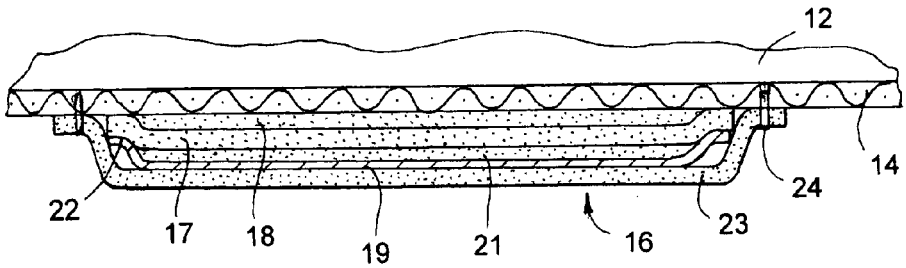
FIG. 4 is a sectional view taken along line 4-4 of FIG. 3.
Figure 5:
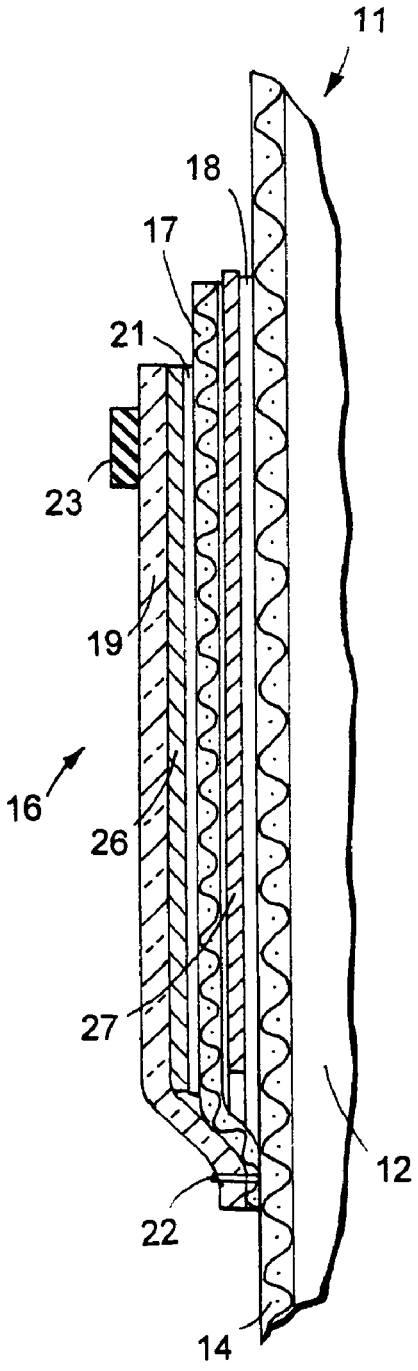
FIG. 5 is a sectional view taken along line 5-5 of FIG. 3.
Figure 6:
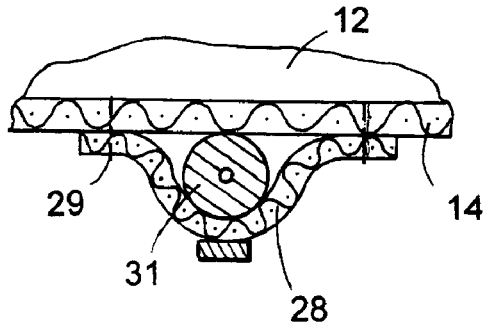
FIG. 6 is a sectional view taken along line 6-6 of FIG. 3.
Figure 7:
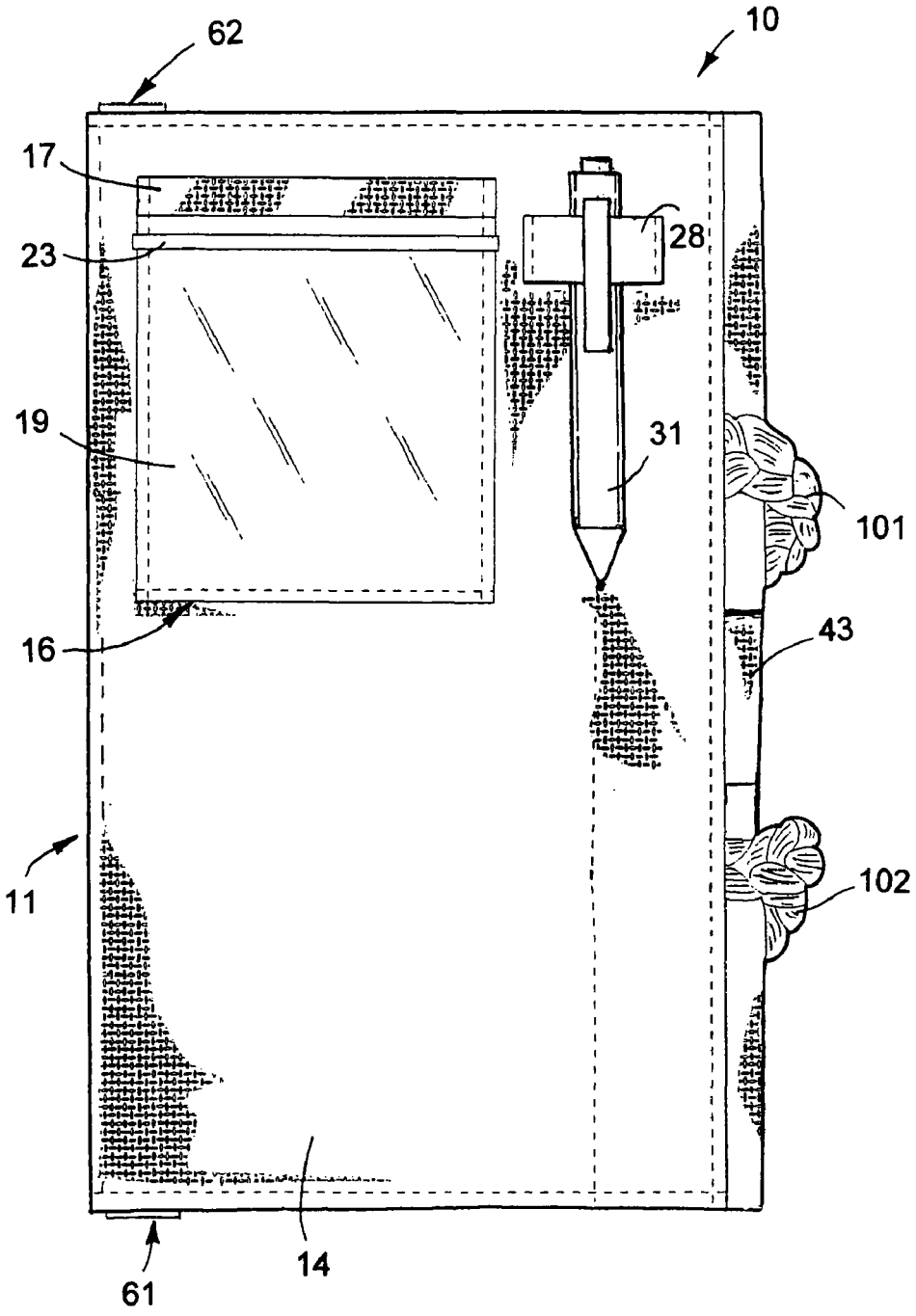
FIG. 7 is a front elevational view showing the panel assembly for holding printed sheet members in an alternative vertical location.

Pocket 11 has an upright rectangular front wall 14 supporting a panel assembly 16 for holding printed materials, such as coupons and paper shopping lists. As shown in FIGS. 3, 4 and 5, a first panel 17 comprising an upright rectangular fabric sheet provides a first cavity 18. A second panel 19 comprising a transparent sheet or film superimposed over panel 17 provides a second cavity 21. The opposite sides and bottom of panels 17 and 19 are attached to front wall 14 with connectors 22, shown as stitches. Panel assembly 16 can include a back wall connected to panels 17 and 19. Releasable fasteners such as hook and loop members, can be used to releasably connect the back wall to front wall 14 of pocket 11. Panel assembly 16 with a back wall can be used independently of pocket 11. Cavities 18 and 21 have vertically spaced top openings to allow sheet materials to be placed into and removed from the cavities. Panel assembly 16 includes a transverse elastic band 23 extended across the upper portion of panel 19. Opposite ends of band 23 are secured to front wall 14 with connectors 24 and maintain band 23 in tension and engagement with panel 19. As shown in FIG. 4, connectors 24 are stitches. Other types of attaching structures can be used to secure band to front wall 14. Returning to FIGS. 3 and 5, a paper sheet 26 is located in cavity 21 behind transparent panel 19. Printed material including handwritten notes and lists on paper sheet 26 are readable by the person using bag assembly 10. The sheet 26 is in a known protected location which avoids the inconvenient use of handheld shopping lists. Coupons and advertising materials 27 can be located in cavity 18. As shown in FIG. 7, an alternative location of panel assembly 16 is at one end of front wall 14. Bag assembly 10 can be placed on end in a shopping cart with panel assembly 16 facing the person. The printed material and coupons retained by panel assembly 16 are in an elevated position convenient for reading and checking off items by the shopper. Panel assembly 16 and elastic band 23 can be secured to other locations, such as the right side of the front wall 14 of pocket 11. As shown in FIGS. 1 to 3, 6 and 7, a U-shaped member 28 having opposite ends is attached with connectors 29 to front wall 14 adjacent the right side of panel assembly 16. A writing instrument 31, such as a pen or pencil, is retained in an upright position by U-shaped member 28. Writing instrument can be removed from U-shaped member 28 for use to add to the list of items or check off acquired items.

Figure 8:
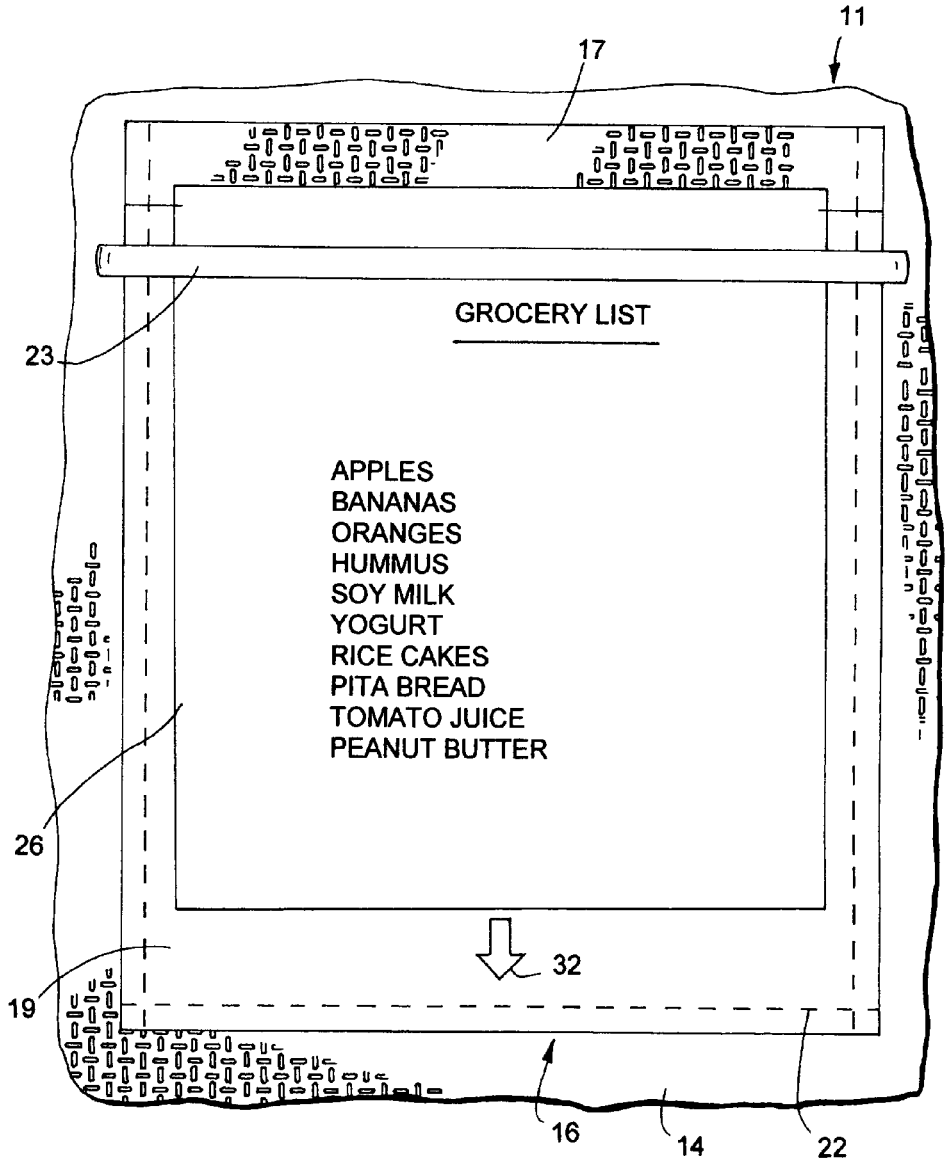
FIG. 8 is a front elevational view of the panel assembly for holding printed sheet materials with a list of items retained thereon with an elastic band.

As shown in FIG. 8, paper sheet 26 containing a grocery list of food items has been removed from cavity 21. The upper end of paper sheet 26 has been placed under elastic band 23 to locate and secure paper sheet 26 on top of transparent panel 19. Writing instrument 31 can be used to check or cross off items from the list, add items to list, or write notes on paper sheet 26. Reusable bag assembly 10 including its front wall 14, panel assembly 16 and elastic band 23 operates as a board or base for sheet 26. Paper sheet 26 can be removed from panel assembly 16 by a quick pull in the direction of arrow 32. The grocery receipt for purchased items can be placed and stored in cavity 21.

Figure 9:
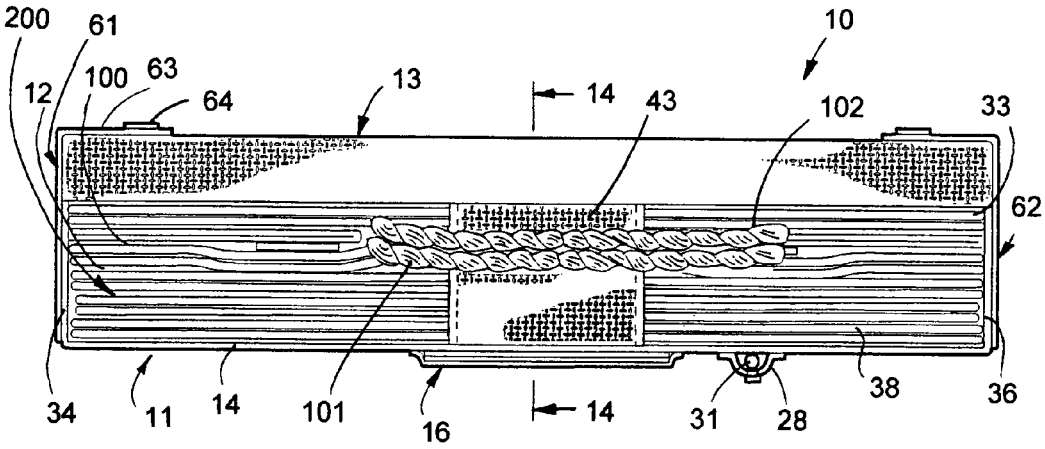
FIG. 9 is a top plan view of the compact reusable shopping bag assembly of FIG. 1.
Figure 10:
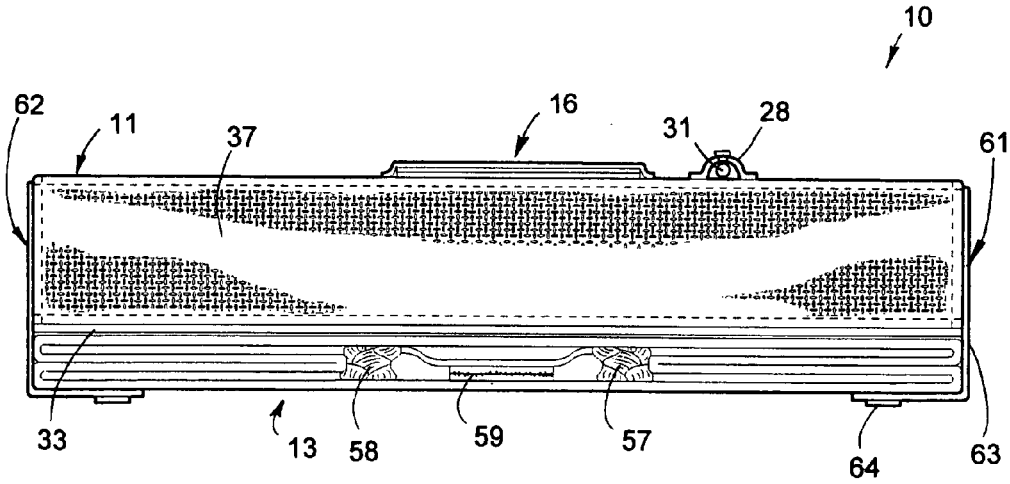
FIG. 10 is a bottom plan view of the compact reusable shopping bag assembly of FIG. 1.

As shown in FIGS. 9 to 12, pocket 11 has an upright rear wall 33 laterally spaced from front wall 14 joined to side walls 34 and 36 and a flat horizontal bottom wall 37 define the three dimensional shape of pocket cavity 12. An upright partition 38 joined to side walls 34 and 36 and bottom wall 37 divides pocket cavity 12 into a front compartment 39 and a main compartment 41 shown in FIGS. 13 and 14. Printed material 42, such as brochures and advertising sheets, are located in front compartment 39. Folded reusable bags 100 and 200 located side-by-side are retained in main compartment 41. Folded reusable bag 100 is shown in FIGS. 24 to 30. Additional folded shopping bags can be positioned in main compartment 41. Reusable bags 100 and 200 are retained in pocket cavity 12 with a flap 43 extended over the middle of the top opening of pocket cavity 12. As shown in FIG. 14, the inner end of flap 43 is secured with connectors 44, such as stitches, to a middle portion of front wall 48 of primary bag 13 in alignment with the top opening of pocket 11. The outer or free end of flap 43 is releasably connected to front wall 14 with a releasable fastener 46, such as a hook and loop releasable fastener. Other types of releasable fasteners can be used to join flap 43 to front wall 14. The upper end of partition 38 has a portion 47 of a releasable fastener usable to connect flap 43 to partition 38. As shown in FIGS. 9 and 14, flap 43 extends under arched handles 101 and 102 to allow handles 101 and 102 to be used to manually carry compact reusable shopping bag assembly 10. When releasable fastener 46 is separated or opened, flap 43 can be moved upwardly, shown by arrow 45 in FIG. 14, to allow one or both auxiliary shopping bags 100 and 200 to be removed upwardly from pocket cavity 12.

Figure 16:
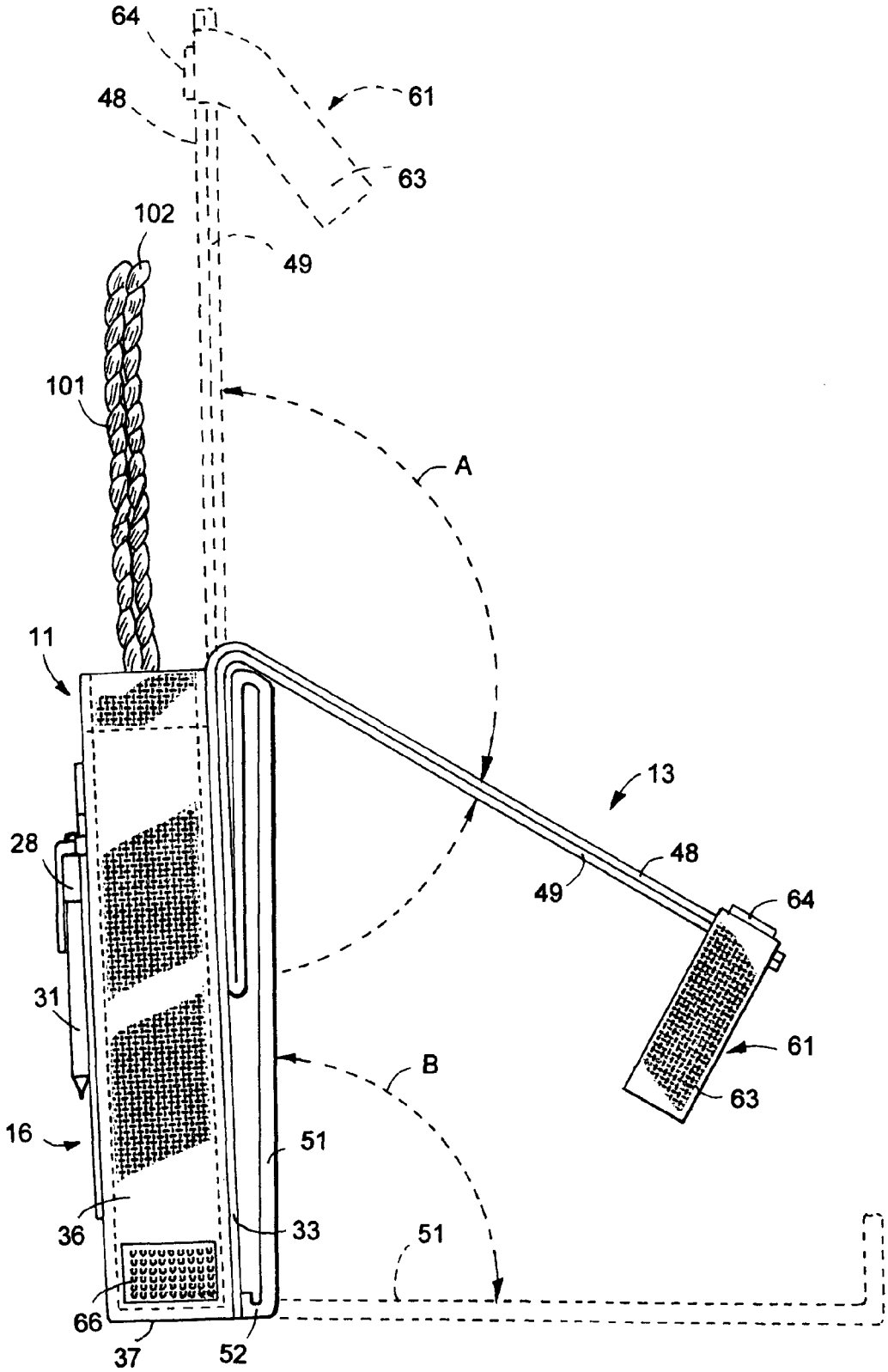
FIG. 16 is a diagrammatic view of the compact reusable shopping bag assembly showing the unfolding of the primary shopping bag from a folded condition to an unfolded condition.

As shown in FIGS. 9 to 12 and 16 to 23, primary shopping bag 13 has a front wall 48 combined with rear wall 33. Front wall 48 and rear wall 33, is a shared one-piece fabric member. Spaced laterally from front wall 48 is a rear wall 49. A bottom wall 51 joined to front and rear walls 48 and 49 is connected to side walls 53 and 54 to provide a chamber 56 when shopping bag 13 is in its open condition as shown in FIGS. 17 to 23. A flat base member 68 is located in chamber 56 adjacent the top of bottom wall 51 to reinforce and maintain the flat rectangular shape of bottom wall 51. A flat base can also be located at the bottom of pocket cavity 12. A linear hinge edge or member 52 connects a horizontal edge of bottom wall 51 to the bottom of back wall 33 of pocket 11. Hinge member 52 allows bottom wall 51 to swing to a horizontal position in horizontal alignment with the bottom wall 37 of pocket 11 as shown in FIG. 16. The horizontally aligned orientation of bottom walls 37 and 51 stabilizes primary shopping bag 13 when in its open condition on a horizontal surface. Returning to FIGS. 10 and 14, when primary shopping bag 13 is in its folded condition, the arched handles 57 and 58 joined to upper portions of front and rear walls 48 and 49 are folded inside closed chamber 56 of primary bag 13. Handles 57 and 58 do not extend downwardly below the bottom of compact reusable shopping bag assembly 10 to allow the shopping bag assembly 10 to be transported in a compact rectangular shape, and supported on a horizontal surface in upright orientation. A releasable fastener 59, such as a hook and loop fastener, closes the open ends of walls 48 to 49 to retain handles 57 and 58 tucked in between walls 48 and 49. Fastener 59 when released allows shopping bag 13 to be opened and handles 57 and 58 moved to upright bag carrying positions.

Figure 11:
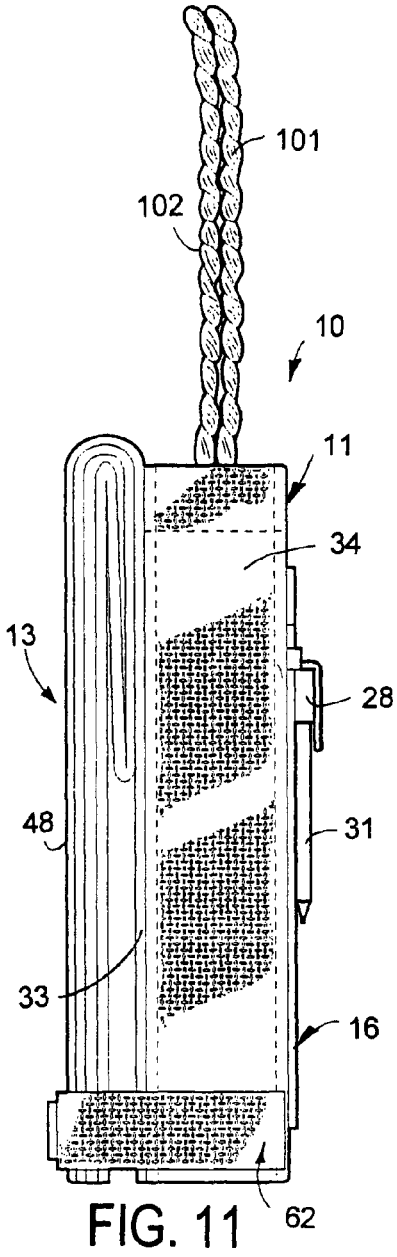
FIG. 11 is a side elevational view of the left side of the compact reusable shopping bag assembly of FIG. 1.
Figure 12:
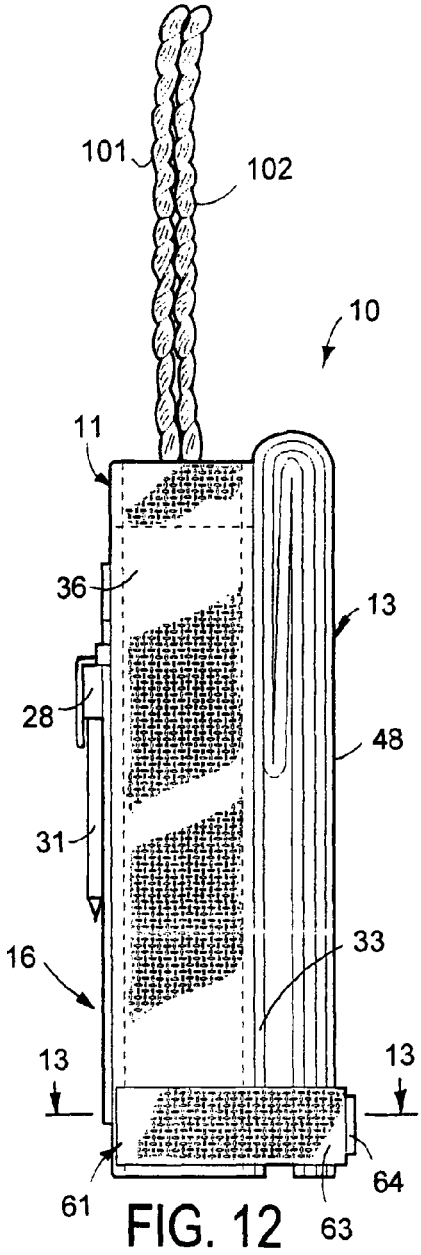
FIG. 12 is a side elevational view of the right side of the compact reusable shopping bag assembly of FIG. 1.
Figure 13:
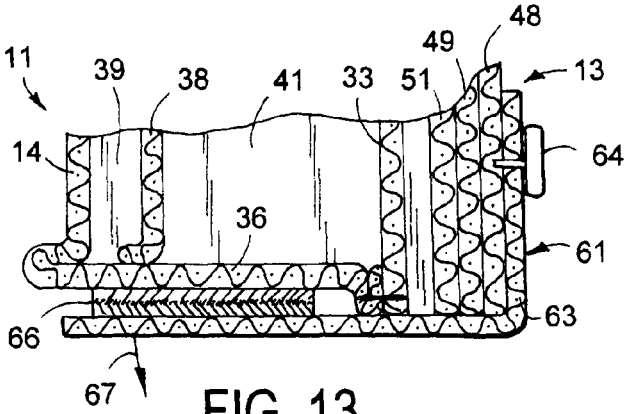
FIG. 13 is an enlarged sectional view taken along the line 13-13 of FIG. 12.
Figure 14:
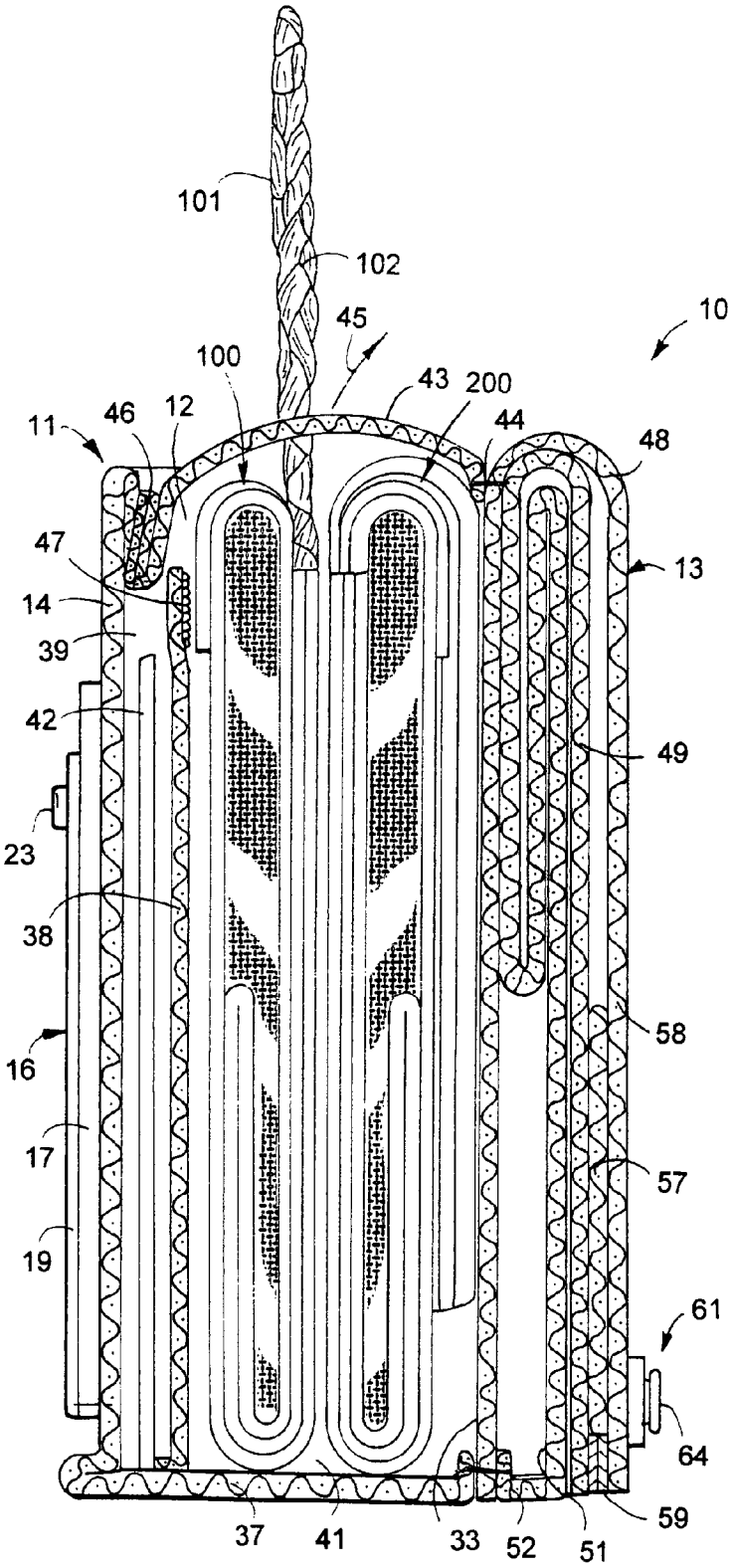
FIG. 14 is an enlarged sectional view taken along the line 14-14 of FIG. 9.
Figure 15:
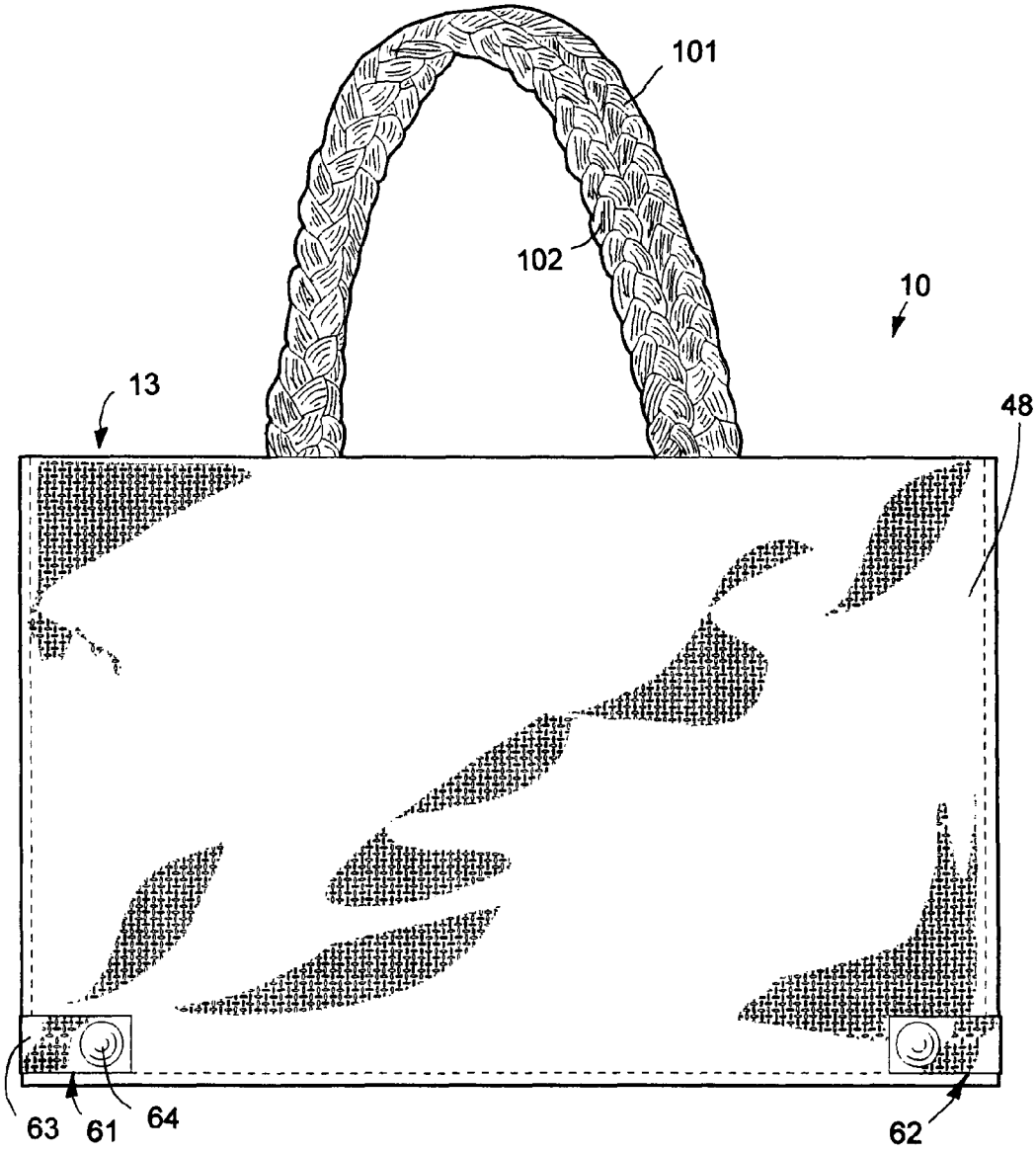
FIG. 15 is a rear elevational view of the compact reusable shopping bag assembly of FIG. 1.
Figure 17:
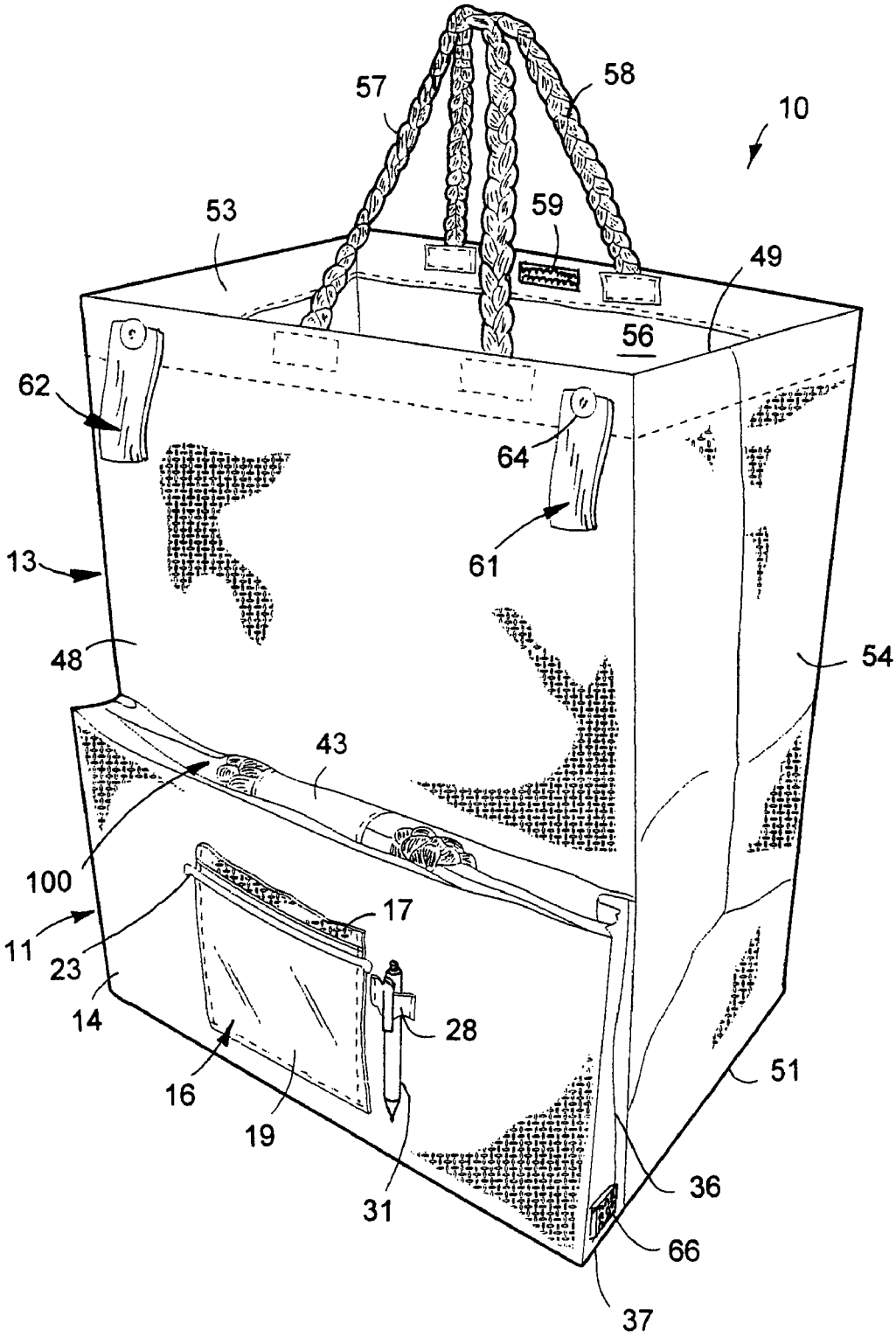
FIG. 17 is a perspective view of the compact reusable shopping bag assembly showing the primary bag in the open unfolded condition.
Figure 18:
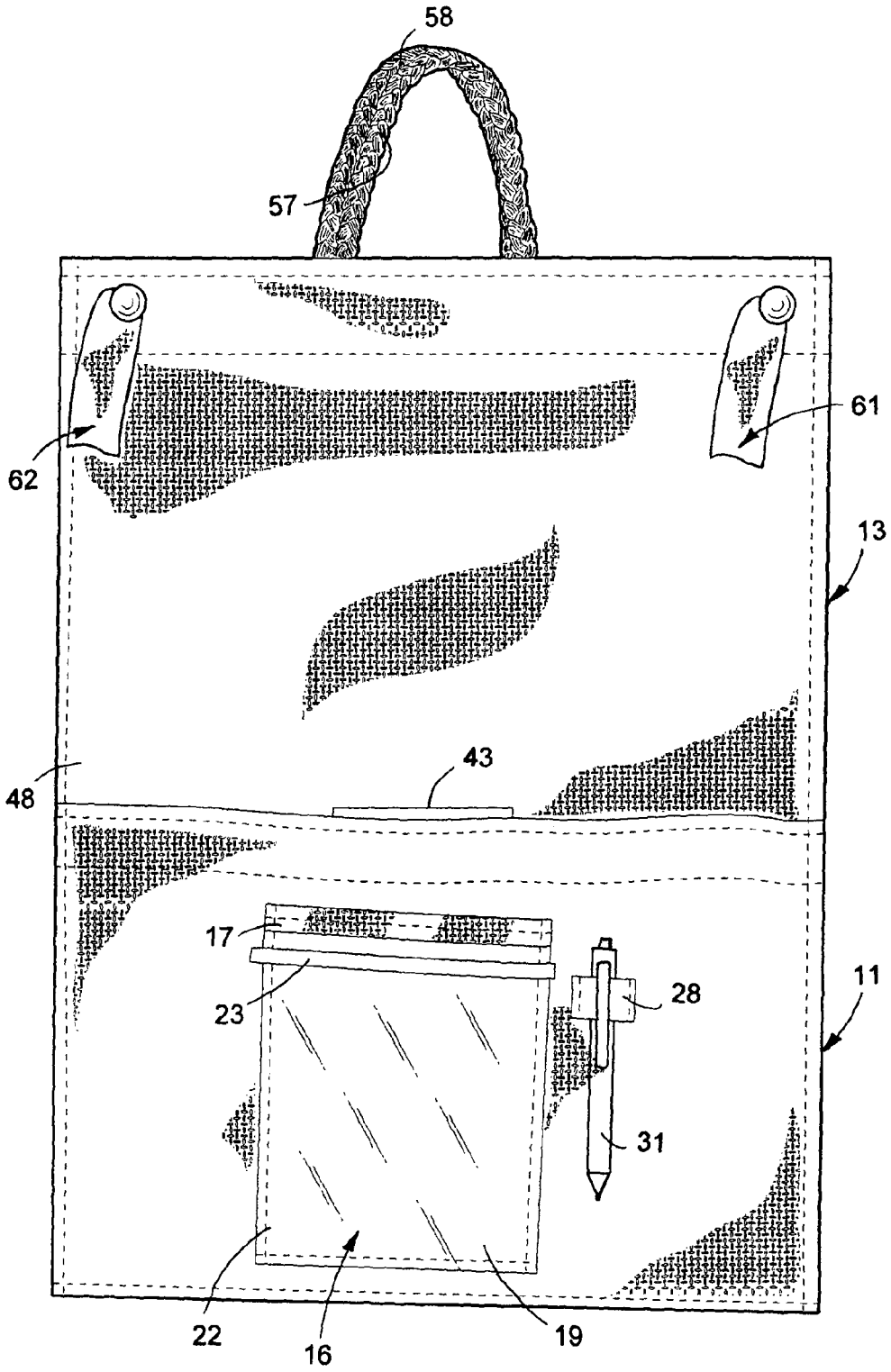
FIG. 18 is a front elevational view of the compact reusable shopping bag assembly shown in FIG. 17.
Figure 19:
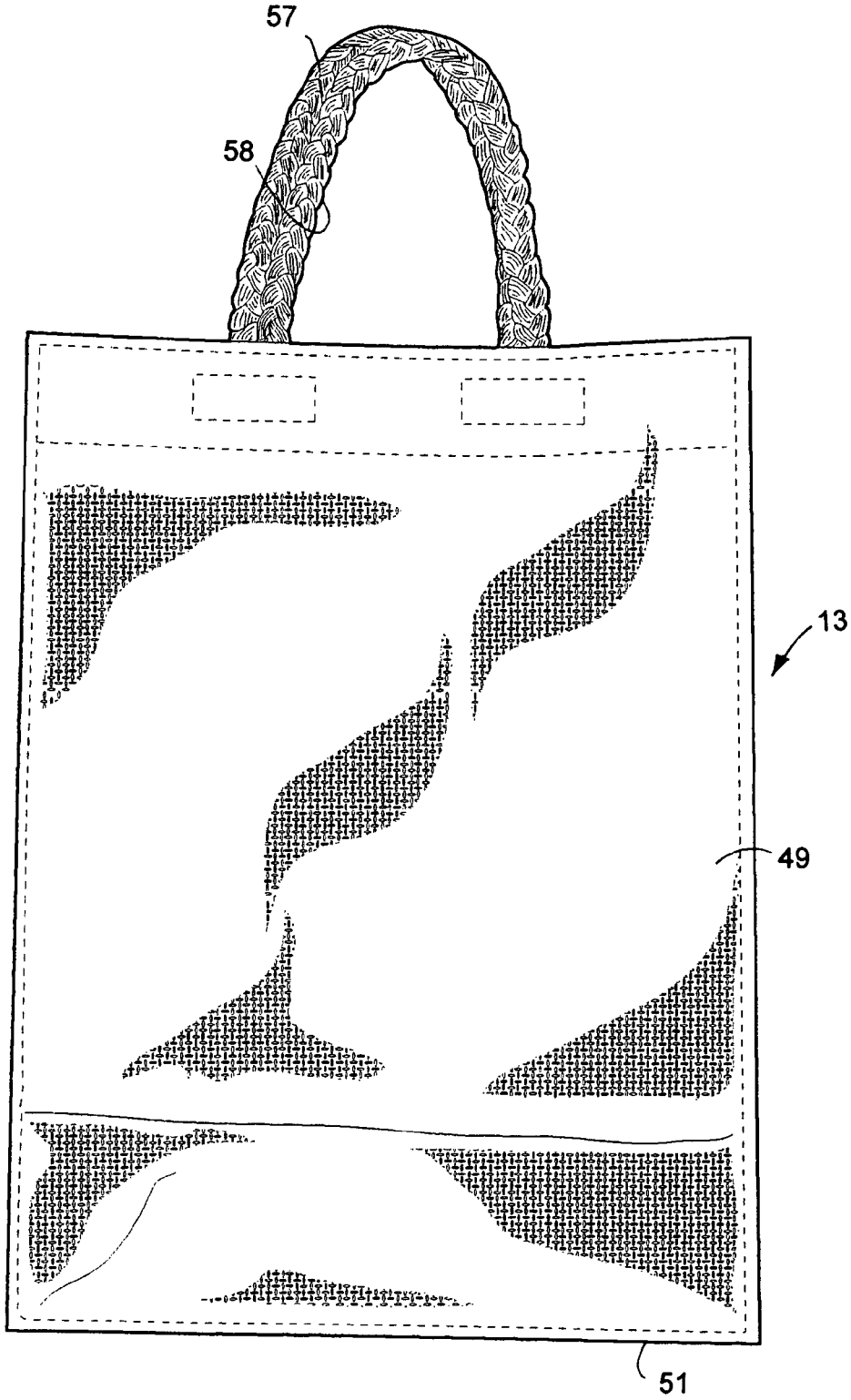
FIG. 19 is a rear elevational view of the compact reusable shopping bag assembly shown in FIG. 17.
Figure 20:
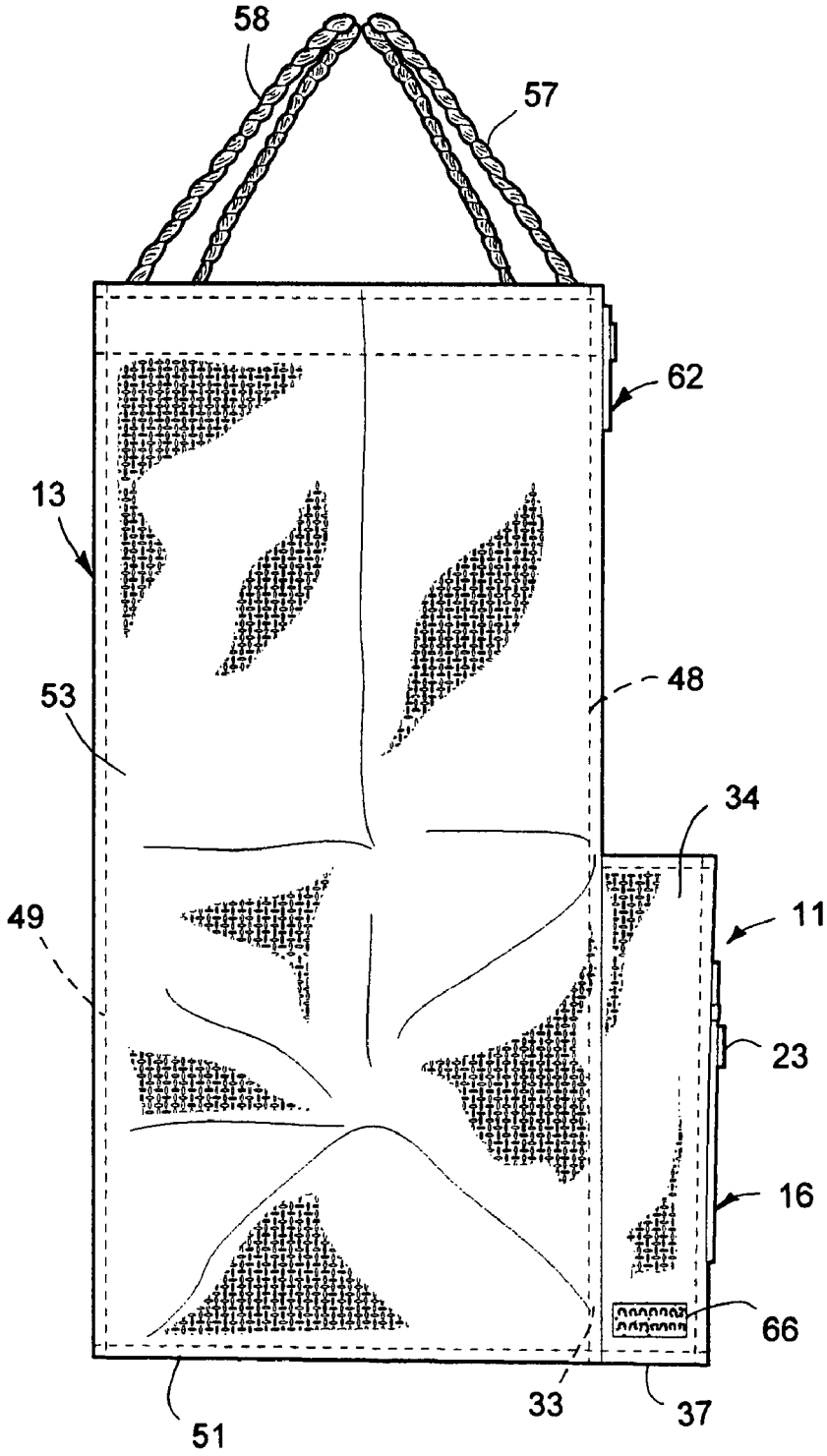
FIG. 20 is a side elevational view of the compact reusable shopping bag assembly shown in FIG. 17.

As shown in FIGS. 9 to 13 and 15, primary shopping bag 13 is retained in its folded condition adjacent the back of pocket 11 with retainers 61 and 62. Retainers 61 and 62 located on opposite lower ends of pocket 11 and top corners of front wall 48 of folded primary shopping bag 13 are identical in structure and function as they retain shopping bag 13 in its compact flat rectangular configuration adjacent the back of pocket 11 and prevent shopping bag 13 from being unfolded. FIGS. 12 and 13 show the details of retainer 61. Retainer 62 has the same structure as retainer 61. Retainer 61 comprises an elongated flat fabric strap 63 having one end connected to front wall 48 of shopping bag 13 with a button 64. Button 64 attaches strap 63 to the upper right corner of front wall 48 of primary bag 13 to allow pivotal movement of straps 63 to a vertical position when primary bag 13 is in its upright open condition as shown in FIG. 17. The opposite end of strap 63 is releasably attached to a lower portion of side wall 34 of pocket 11 with a releasable fastener 66, such as a hook and loop fastener. Strap 63 can extend around side wall 34 of pocket 11 and connect with releasable fasteners to the lower corners of front wall 14 of pocket 11 and top corners of folded front wall 48 of primary shopping bag 13. Other types of releasable fasteners can be used to attach strap 63 to side wall 34 of pocket 11 and front wall 48 of shopping bag 13. For example, buttons and snap buttons can be used to releasably attach strap 63 to wall 48 of primary shopping bag 13. Retainers 61 and 62 can be loop and button devices that maintain primary shopping bag 13 in a folded condition adjacent the back of pocket 11. When releasable fastener 66 is opened, strap 63 can be moved away from wall 34, shown by arrow 67 in FIG. 13, to allow primary shopping bag 13 to be unfolded to its open condition.

As shown in FIGS. 11 to 13, retainers 61 and 62 hold primary shopping bag 13 in its folded condition adjacent and parallel to the back of pocket 11 and prevents folded top corners of primary bag 13 to bend outward from repeated use. Retainers 61 and 62 must be released by a person to permit primary shopping bag 13 to be converted to its open unfolded condition. As seen in FIG. 13, strap 63 of retainer 61 is pulled away, shown by arrow 67, from releasable fastener 66 to separate primary bag 13 from pocket 11. Retainer 62 is also released from pocket 11 by pulling its strap from a releasable fastener as illustrated by strap 63 and arrow 67 in FIG. 13. As shown in FIG. 16, primary shopping bag 13 is unfolded by swinging front and rear walls 48 and 49 in an upward direction shown by arrow A to an upright position shown in broken lines. The bottom wall 51 being connected to pocket 11 with a longitudinal hinge edge or member 52 is pivoted downwardly away from the back of pocket 11, as shown by arrow B, to a horizontal position shown in broken lines. The bottom wall 37 of pocket 11 is horizontally aligned with horizontal bottom wall 51 of primary shopping bag 13 and concurrently engage in a support to stabilize the shopping bag assembly. Separating releasable fastener 59 allows front and rear walls 48 and 49 to be spread apart to provide a rectangular top opening to chamber 56 of primary shopping bag 13. As shown in FIG. 17, retainers 61 and 62 are pivoted downward to vertical positions in alignment with front wall 48 of primary bag 13. Alternatively, releasable fasteners, such as hook and loop members or snaps, can be connected to the top four corners of side walls 53 and 54 of primary bag 13, and a portion of releasable fasteners connected to on the top corners of rear wall 49 of primary bag 13 with matching portions connected to bottom wall 51 of primary bag 13 to hold the reusable shopping bag assembly 10 in its folded condition.

Figure 21:
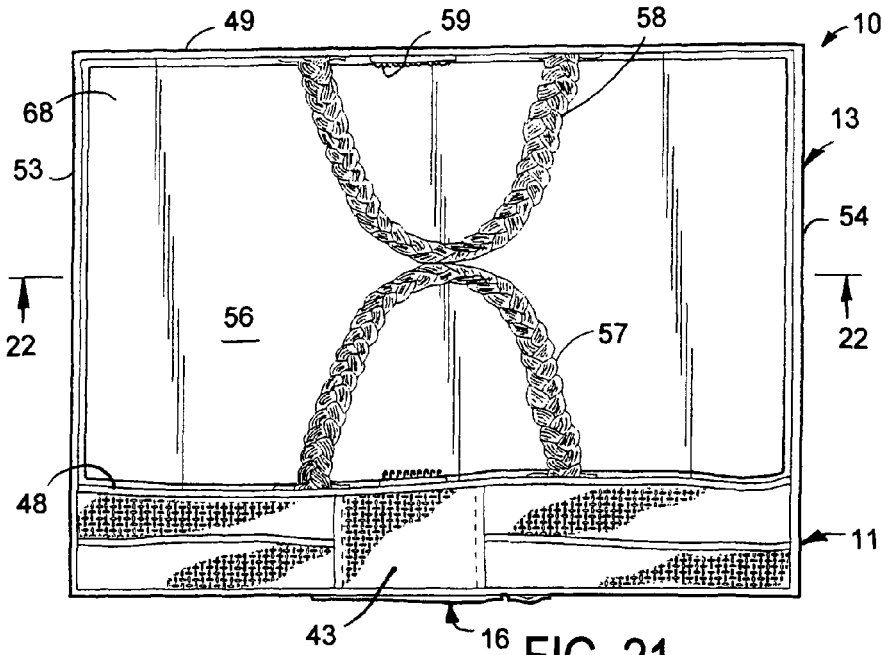
FIG. 21 is a top plan view of the compact reusable shopping bag assembly shown in FIG. 17.
Figure 22:
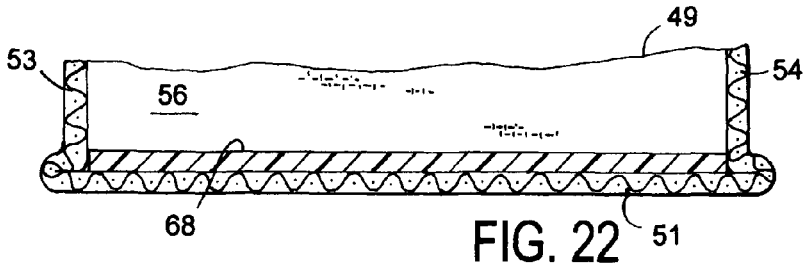
FIG. 22 is a sectional view taken along the line 22-22 of FIG. 21.
Figure 23:
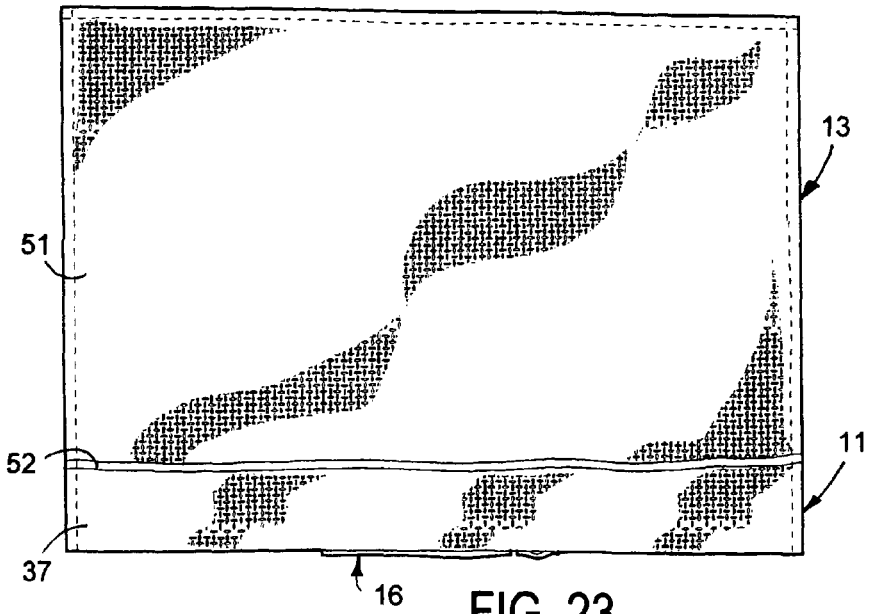
FIG. 23 is a bottom plan view of the compact reusable shopping bag assembly shown in FIG. 17.

The primary shopping bag 13 in an upright open condition, shown in FIGS. 17 to 23, has a rectangular top opening to allow merchandise and food items to be placed into and removed from chamber 56. The bottom wall 37 of pocket 11 and bottom wall 51 of primary shopping bag 13 are located in a common horizontal plane which when placed on a horizontal support, such as a table, shelf or counter, maintain pocket 11 and primary shopping bag 13 in an upright open condition. The location of pocket 11 relative to primary bag 13 and horizontal aligned bottom walls 37 and 51 provides reusable bag assembly 10 with a low center of gravity thereby stabilizing and preventing tipping of the reusable bag assembly on a flat support surface. Pocket 11 with reusable auxiliary bags 100 and 200 contained in pocket cavity 12 along with primary bag 13 remain in an upright condition when aligned bottom walls 37 and 51 rest on the flat support surface. The upright open primary shopping bag 13 provides convenient and advantageous access to chamber 56 and the items located in chamber 56 and their placement into and removal from chamber 56. As shown in FIGS. 21 and 22, a flat base member or floor board 68 is located in the bottom of chamber 56 on top of bottom wall 51 of primary shopping bag 13. Member 68 has a rectangular shape that coincides with the rectangular shape of bottom wall 51 to maintain a strong and flat bottom wall 51. An example of member 68 is a flat plastic composite or cardboard plate. The plate can have a plurality of holes to reduce its weight. Member 68 is removable from chamber 56 to allow member 68 to be cleaned or replaced with another member.

The first auxiliary reusable shopping bag 100 is shown in FIGS. 24 to 31 in a folded condition and in FIGS. 32 to 37 in an open unfolded condition. Reusable bag 100 has a front wall 103 and a rear wall 104 laterally spaced from front wall 103. A panel assembly 105 attached to front wall 103 has a first panel 106 and a second transparent panel 107 superimposed over first panel 106. An elastic band 108 extends transversely across upper portions of panels 106 and 107. Opposite ends of elastic band 108 are secured to front wall 103 to maintain the band in tension and in engagement with panel 107. Panel assembly 105 has the same uses as panel assembly 16 shown in FIGS. 3 to 5. A U-shaped member 109 attached to front wall 103 adjacent the right side of panel assembly 105 functions as a holder for a writing instrument 111, such as a pen or pencil.

Figure 24:
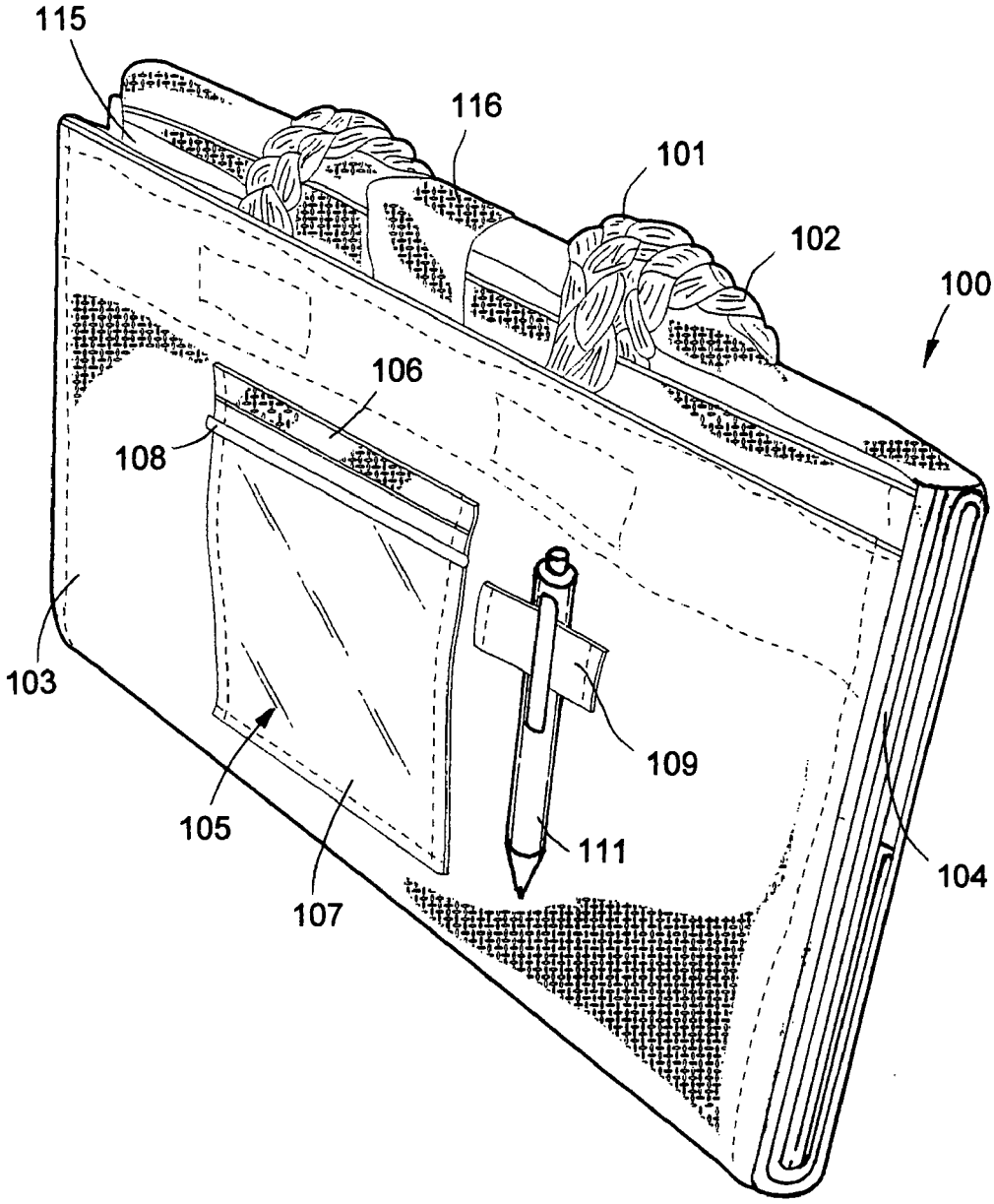
FIG. 24 is a perspective view of a folded first reusable auxiliary bag usable with the compact reusable shopping bag assembly of FIG. 1.
Figure 25:
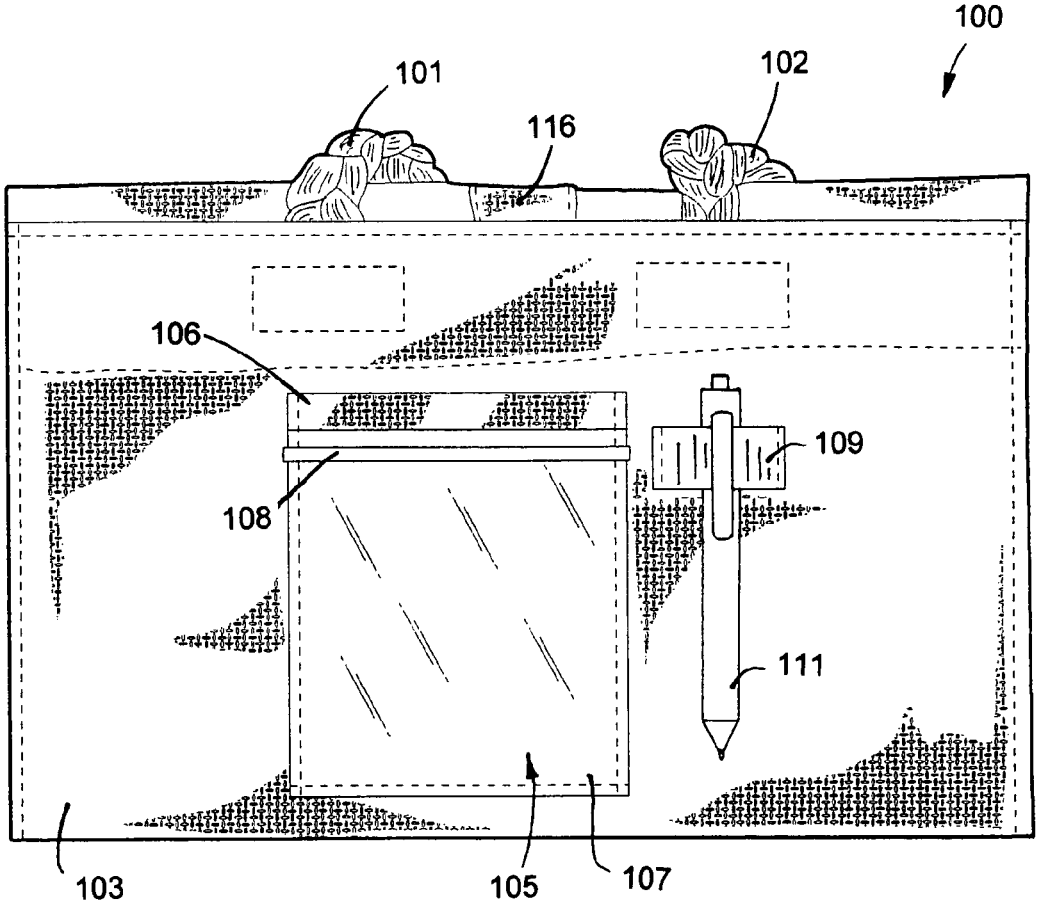
FIG. 25 is a front elevational view of the reusable bag of FIG. 24.
Figure 26:
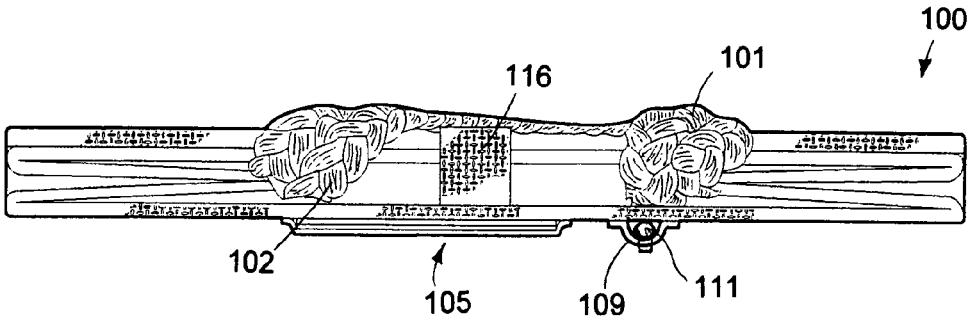
FIG. 26 is a top plan view of the reusable bag of FIG. 24.
Figure 27:
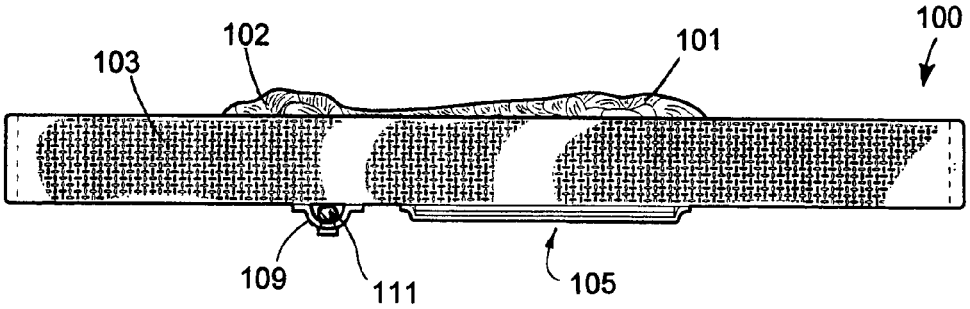
FIG. 27 is a bottom plan view of the reusable bag of FIG. 24.
Figure 28:
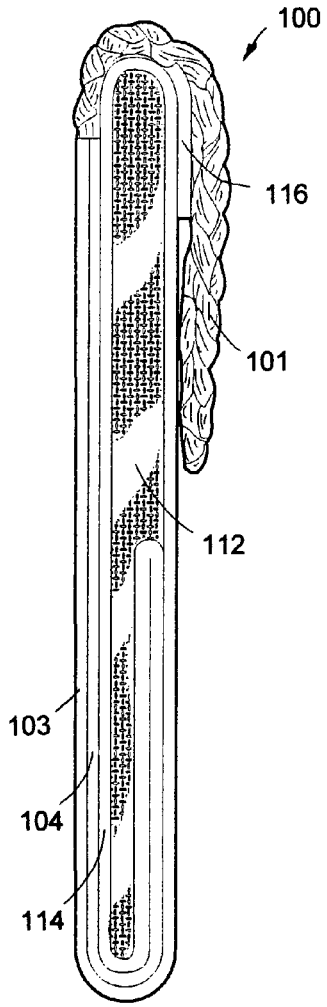
FIG. 28 is a side elevational view of the right side of FIG. 24.
Figure 29:
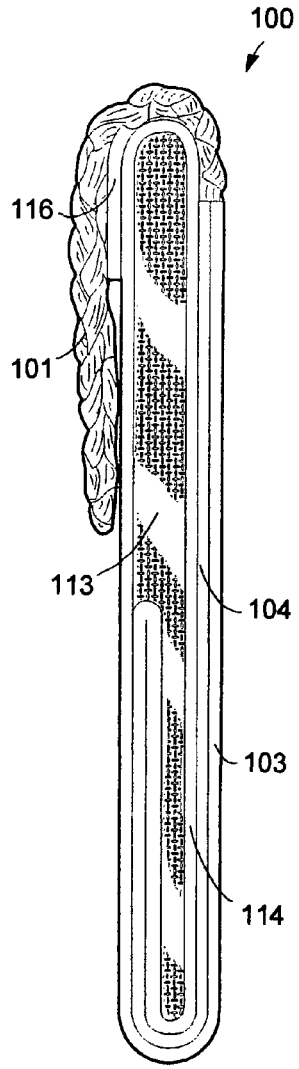
FIG. 29 is a side elevational view of the left side of FIG. 24.
Figure 30:
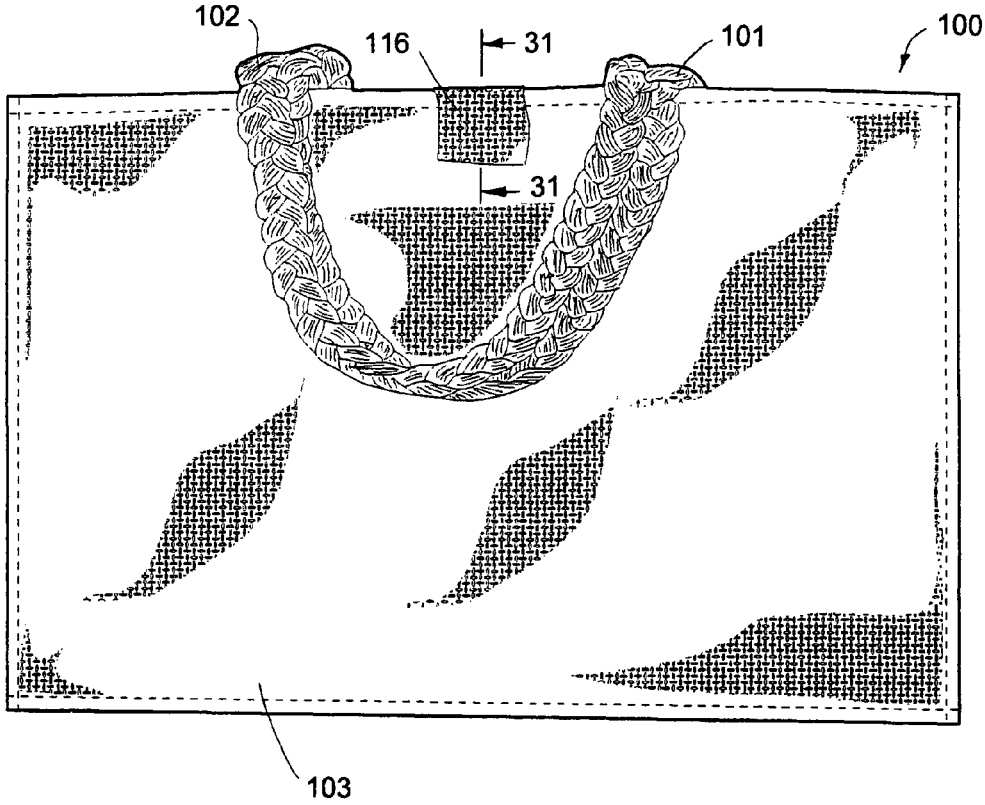
FIG. 30 is a rear elevational view of the reusable bag of FIG. 24.
Figure 31:
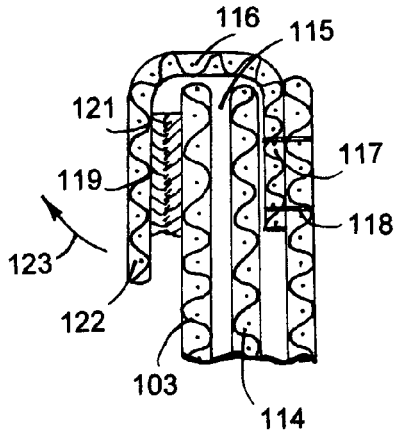
FIG. 31 is an enlarged sectional view taken along line 31-31 of FIG. 30.
Figure 32:
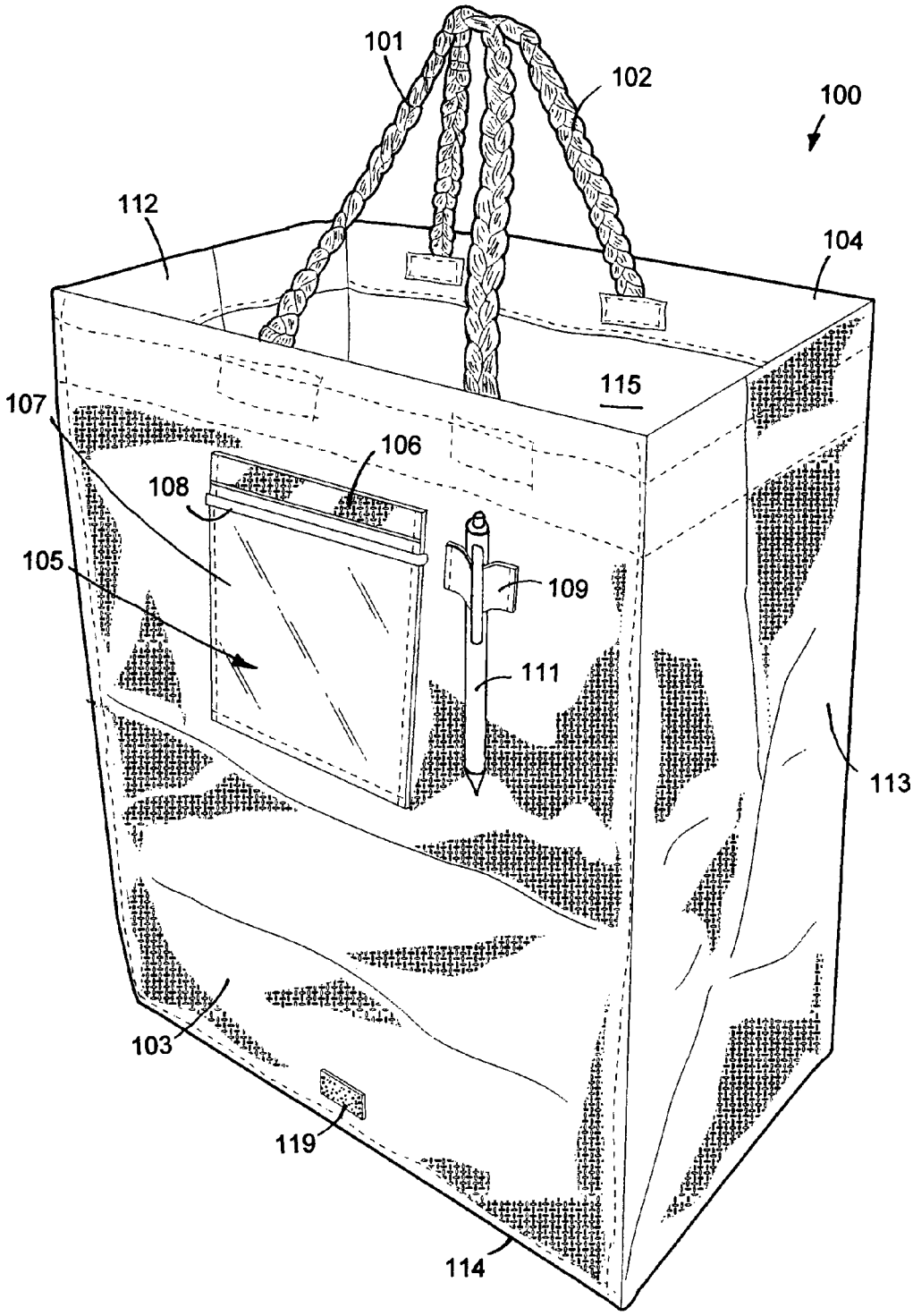
FIG. 32 is a perspective view of the open reusable bag of FIG. 24.
Figure 33:
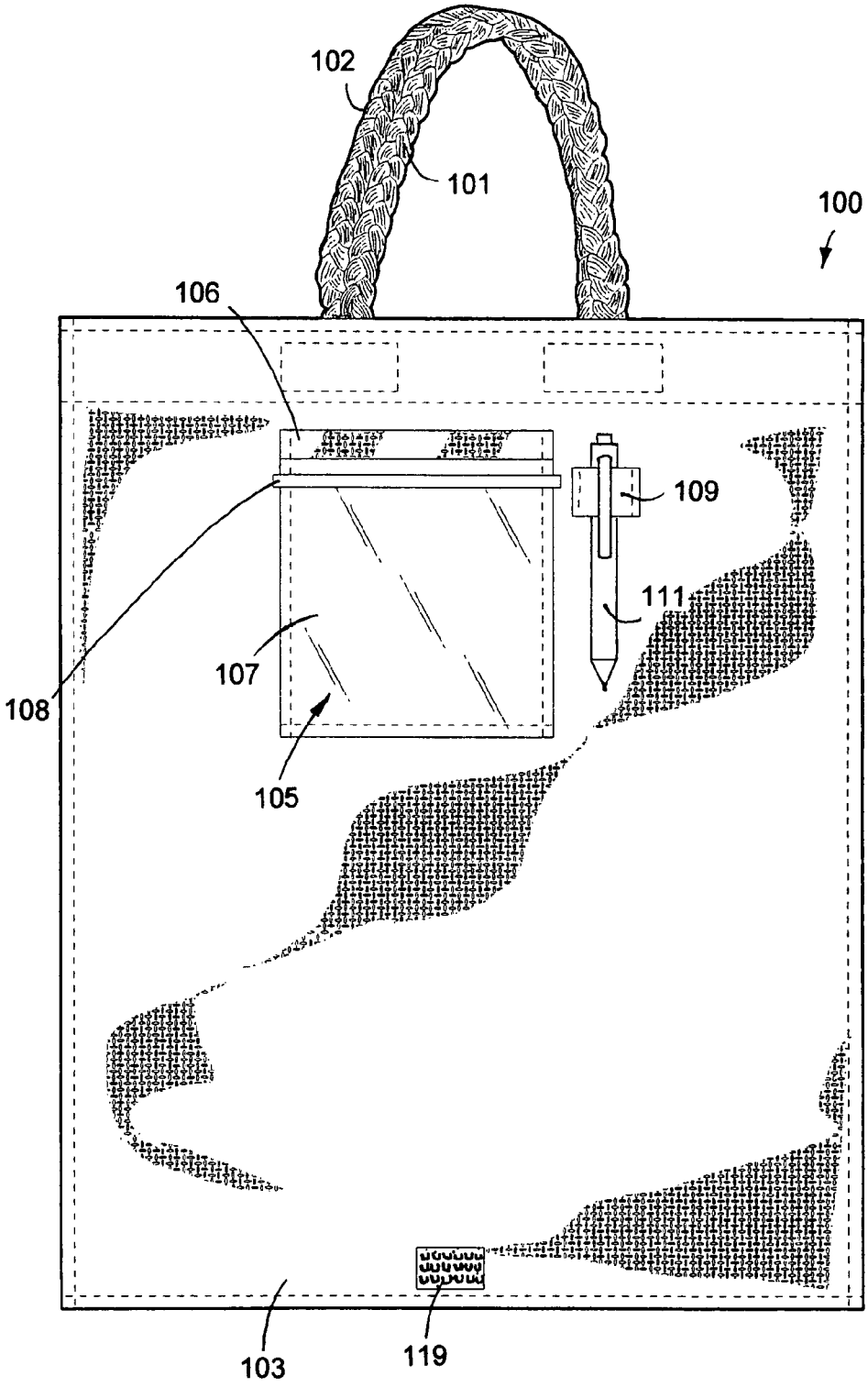
FIG. 33 is a front elevational view of the reusable bag of FIG. 32.
Figure 34:
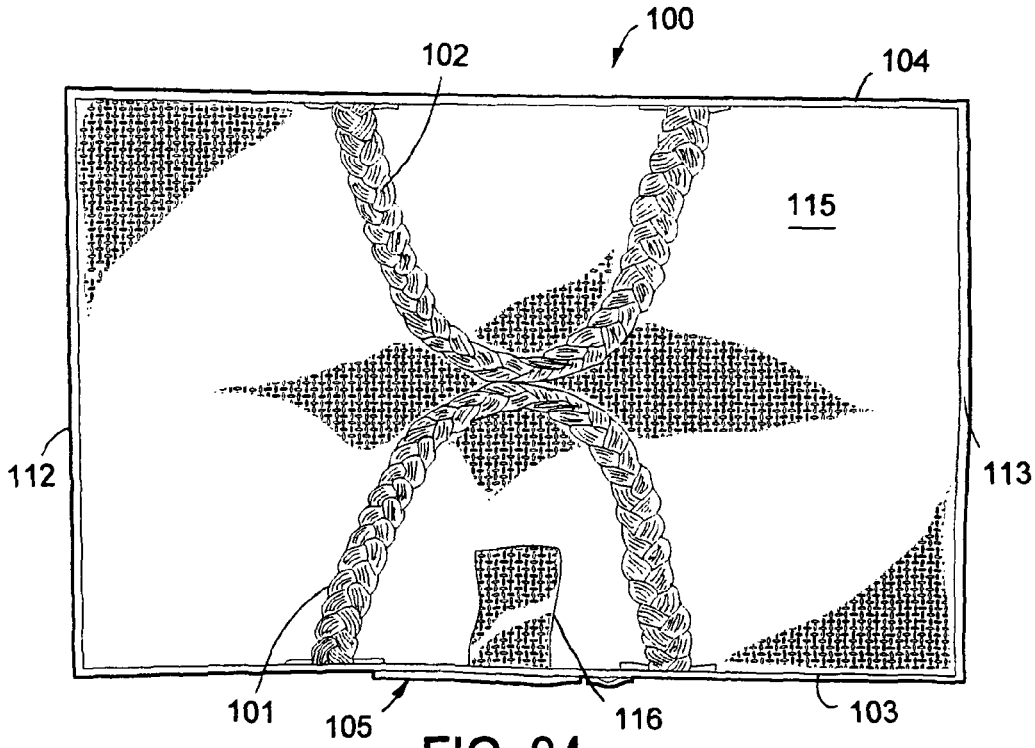
FIG. 34 is a top plan view of the reusable bag of FIG. 32.
Figure 35:
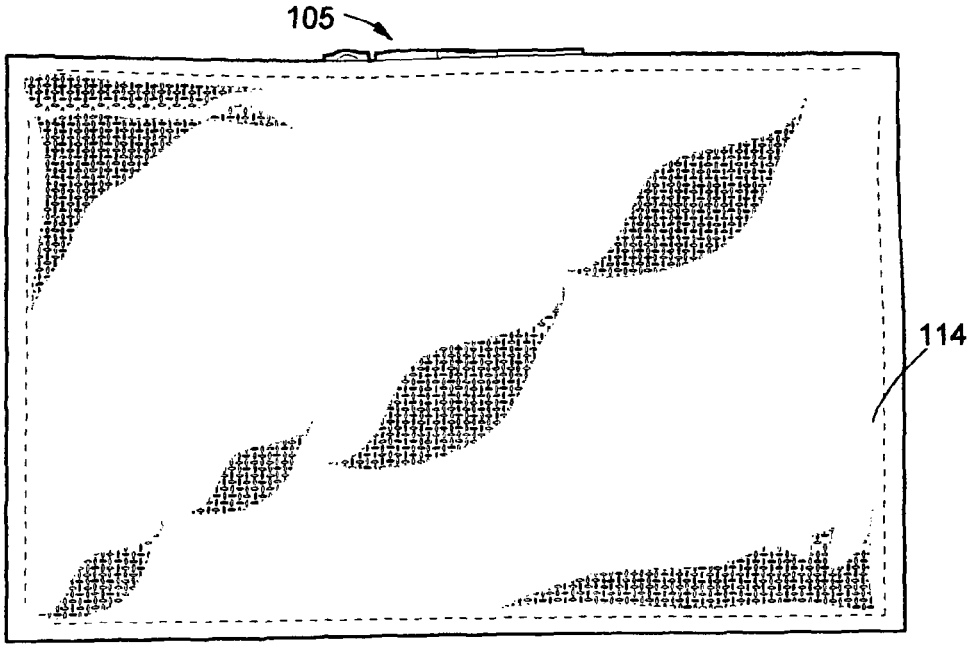
FIG. 35 is a bottom plan view of the reusable bag of FIG. 32.
Figure 36:
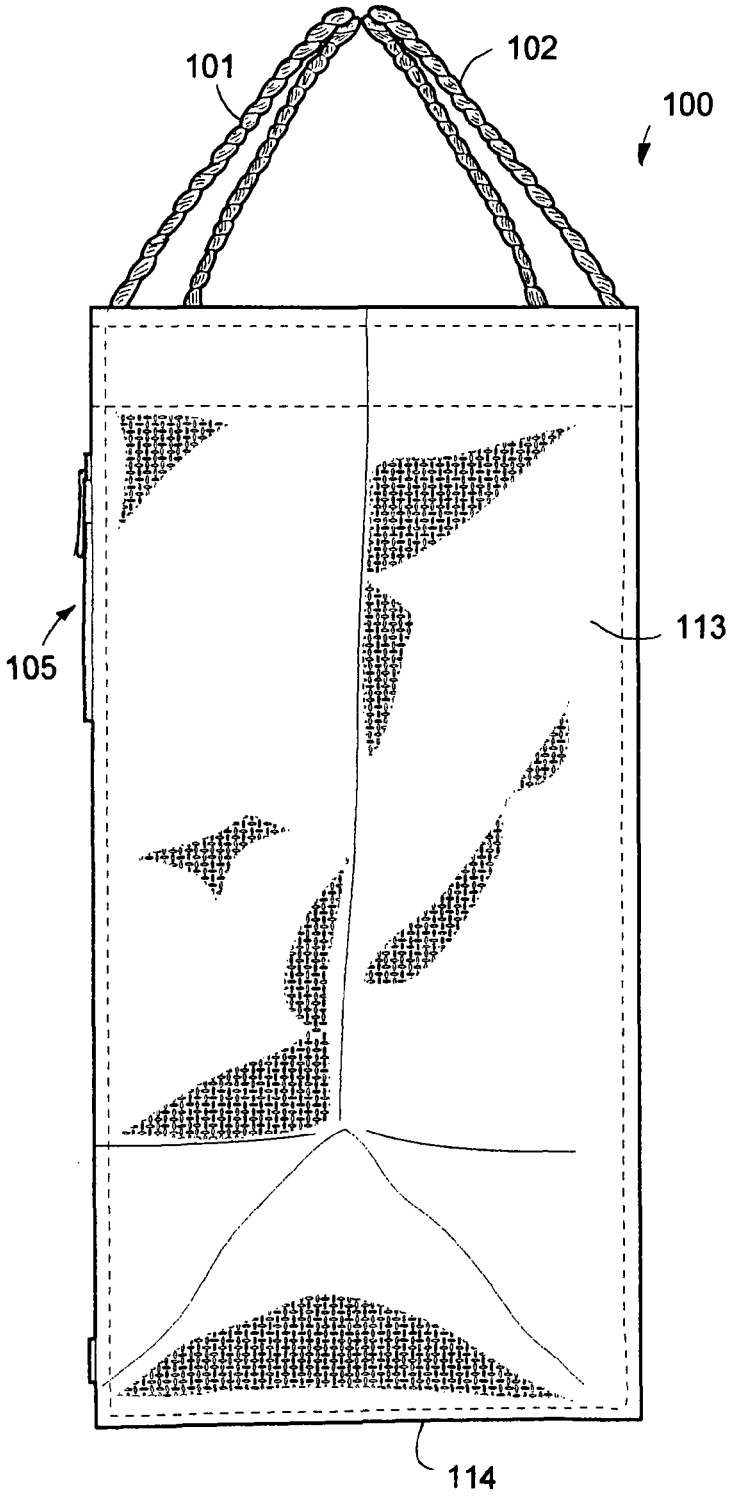
FIG. 36 is a side elevational view of the reusable bag of FIG. 32.
Figure 37:
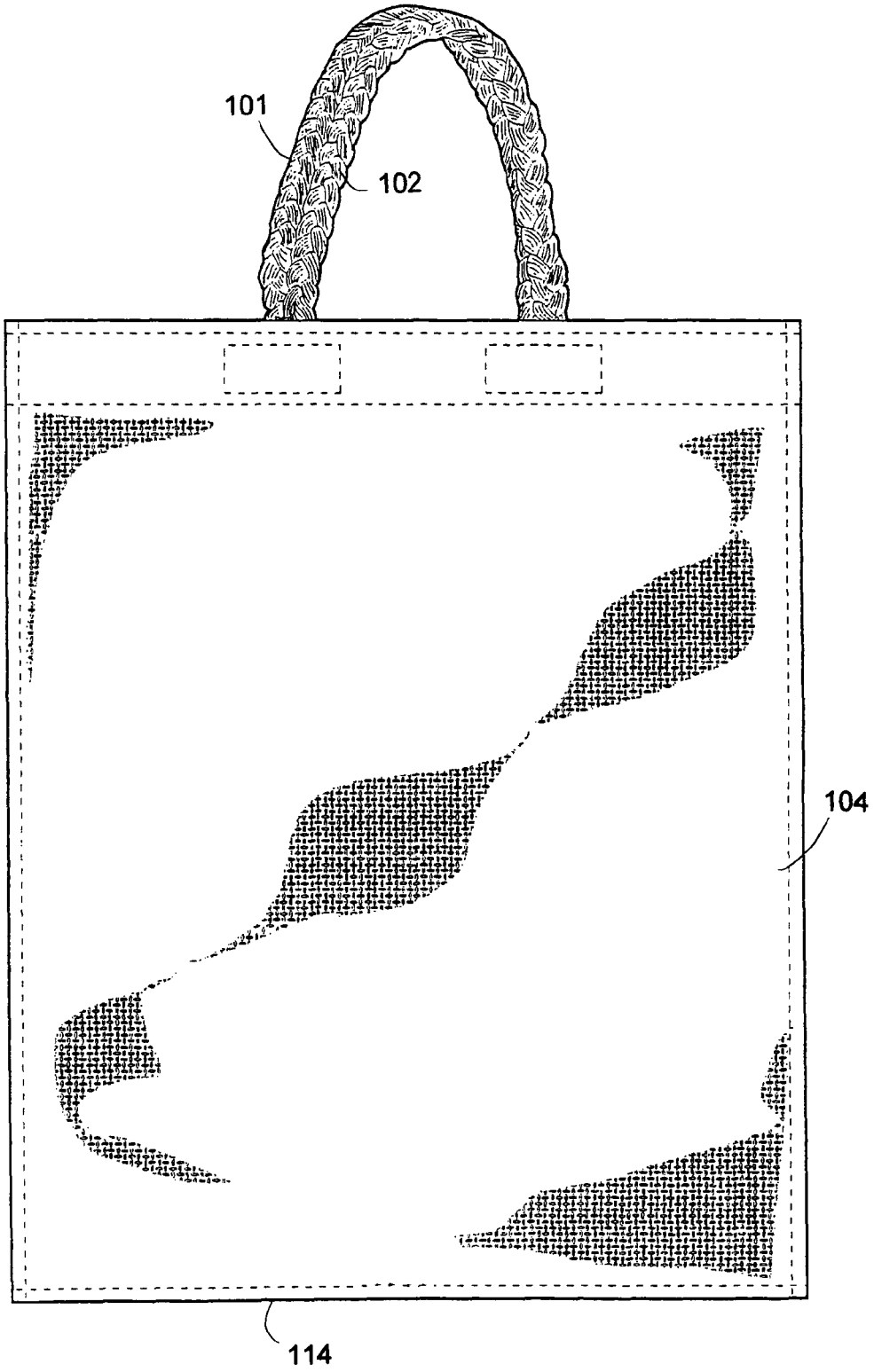
FIG. 37 is a rear elevational view of the reusable bag of FIG. 32.

Reusable bag 100 has upright side walls 112 and 113 and a bottom wall 114 joined front and rear walls 103 and 104 that provide a chamber 115 for accommodating merchandise and food items. The top of chamber 115 is open to allow access to chamber 115. The front rear and bottom walls 103, 104 and 114 can be a one-piece fabric member, such as textile from hemp, bamboo, seaweed, straw and other sturdy plants. Other materials, such as jute, canvas and recyclable polypropylene, or recycled polyethylene can be used to make reusable bag 100. Material designed to store hot and cold items for a length of time can also be used for an auxiliary bag. Side walls 112 and 113 are made of the same material as walls 103, 104 and 114. As shown in FIGS. 24, 30 and 31, reusable bag 100 is maintained in the folded condition with a flap 116 having one end 117 attached with connectors 118, such as stitches, to the upper middle section of front wall 103 and an opposite end attached to the bottom of front wall 103. As shown in FIG. 31, flap 116 extended over the top of closed chamber 115 and under handles 101 and 102 has a free end 121 located adjacent the outside of the middle upper section of front wall 103. A releasable fastener 119, such as a hook and loop or loop and button fastener, releasably attaches flap 116 to the bottom center of front wall 103 thereby holding shopping bag 100 in its folded position. End 121 of flap 116 has a tab 122 which can be finger gripped to separate releasable connector 119. Tab 122 is moved in the direction of arrow 123 to release fastener 119. In use handles 101 and 102 are flexible braided fibers that can be moved to upright positions to facilitate hand carrying of the folded and unfolded reusable bag 100 separately from the reusable shopping bag assembly 10. Handles 101 and 102 can be made of other materials, such as fabric or plastic webs and straps.

Reusable auxiliary bag 100 in its unfolded open condition, shown in FIGS. 32 to 36 has a flat bottom wall 114 adapted to support bag 100 in an upright position on a horizontal surface, such as a table, shelf or counter. The top of bag 100 is open to chamber 115 to allow merchandise and food items to be placed in and removed from chamber 115. A member or flexible floor board, such as member 68 shown in FIGS. 21 and 22, can be placed in chamber 115 on top of bottom wall 114 to reinforce and maintain bottom wall 114 expanded and flat.

A second auxiliary reusable shopping bag 200 shown in FIGS. 38 to 42 in an open unfolded condition has all the structure and features as auxiliary shopping bag 100 except for handles 224 and 226 secured to upper portions of the front and rear walls 203 and 204. Handles 224 and 226 are elongated straps having upright lengths adapted to extend over a person's shoulder whereby reusable bag 200 can be supported by and carried on a person's shoulder. The elements of shopping bag 200 that correspond to the elements of reusable bag 100 have the prefix "2" in lieu of the prefix "1." Shopping bag 200 is foldable into a generally flat compact rectangular condition that corresponds to the folded condition of shopping bag 100 shown in FIGS. 24 to 31. The folded shopping bag 200 is placed in pocket cavity 12 adjacent folded shopping bag 100 as shown in FIGS. 9 and 14. Flap 43 releasably attached to front wall 14 of pocket 11 with releasable fastener 46 retains auxiliary shopping bags 100 and 200 in pocket cavity 12 of pocket 11. Shopping bag 200 in its unfolded open condition, shown in FIGS. 38 to 42 has a flat bottom wall 214 adapted to support bag 200 in an upright position on a horizontal surface, such as a table, shelf or counter. The top of bag 200 is open to chamber 215 whereby merchandise and food items can be placed in and removed from chamber 215. A semi-rigid member or floor board, such as member 68 shown in FIGS. 20 and 21, can be placed in chamber 215 on top of bottom wall 214 to reinforce and maintain bottom wall 214 expanded and flat.

In use, the shopper collects coupons from advertising materials and magazines, and places them in cavity 18 of pocket assembly 16 shown in FIG. 5. Other sheet materials such as store flyers, advertising sheets, brochures, and recipes can be placed in front compartment 39 of pocket 11. A list of items to be purchased is prepared on sheet 26 and placed in cavity 21 behind transparent panel 19 as shown in FIG. 3. Writing instrument 31 is placed behind member 28 before shopping bag assembly 10 is transported to the marketplace. Handles 101 and 102 are used to hand carry compact reusable shopping bag assembly 10 to a conventional shopping cart. Alternatively, straps 224 and 226 can be used to carry shopping bag assembly 10 on a person's shoulder. The shopping bag assembly 10 is placed on the shelf part of the shopping cart with panel assembly 16 facing the person whereby the person can view the shopping list on sheet 26. The person then proceeds to examine produce, grocery and dairy items and place selected items in the basket of the shopping cart. Writing instrument 31 can be used to line out or check off acquired items from sheet 26. The sheet 26 containing the list of items is retained on the top of transparent panel 19 by placing the upper end of the sheet under elastic band 23. At the checkout station, the shopper removes the coupons from cavity 18 to obtain coupon credits from the electronic checkout system of the grocery or retail store. After payment for the purchased items the person opens primary shopping bag 13 by releasing retainers 61 and 62 and unfolding bag 13 to its open unfolded condition shown in FIGS. 16 to 23. The bottom wall 51 being hinged to the bottom of rear wall 33 of pocket 11 swings downward to a generally horizontal position and is placed on the checkout stand. Fastener 59 is opened and handles 57 and 58 are released and brought to upright positions. The open primary shopping bag 13 is maintained in an upright position to allow purchased items to be conveniently placed in chamber 56 of primary shopping bag 13. Handles 57 and 58 can then be used to manually place shopping bag assembly 10 back into the shopping cart for transport to a vehicle. In the event that additional shopping bags are needed for holding purchased items, shopping bag 100 or shopping bags 100 and 200 can be removed from pocket cavity 12 of pocket 11, opened, and filled with purchased items. Empty pocket cavity 12 can be used to transport smaller purchased items such as gum and sponges, or flat items such as periodicals. Additional shopping bags 100 and 200 are placed in the shopping cart for transport to the vehicle. All of the reusable shopping bags 13, 100 and 200 can be manually carried together to the vehicle and removed from the vehicle for transport to use and storage locations or carried directly to the shopper's residence having bag 200 with elongated straps 224 and 226 carried on a person's shoulder while bags 13 and 100 with arched handles 57, 58, 101 and 102 are carried in each hand of the person. The reusable shopping bags 13, 100 and 200 have substantial strength whereby the bags can be manually carried without tearing or breaking. After shopping bags 13, 100 and 200 are unloaded, shopping bag 13 is folded with handles 57 and 58 sandwiched between its front and rear walls and retained therein with releasable fastener 59. Retainers 61 and 62 are connected to pocket side walls 34 and 36 with releasable fasteners 66 to hold primary shopping bag 13 in its folded condition adjacent pocket 11. Reusable bags 100 and 200 are then folded and placed side-by-side in cavity 12 of pocket 11 with preferred carrying handles 101 and 102 or 224 and 226 extended upwardly outside of pocket 11. Flap 43 is then placed under handles and connected to fastener 46 to retain auxiliary shopping bags 100 and 200 folded in cavity 12 of pocket 11. The compact reusable shopping bag assembly 10 is in condition for subsequent use. Shopping bag assembly 10 can be hung on a door or drawer knob or hook for convenient and easy storage.

In summary, the reusable bag assembly 10 of the invention is an efficiently compact and user-friendly product designed to carry numerous reusable bags in a single form made with durable and environmentally sound materials. A panel assembly 16 for holding shopping lists, coupons and other printed materials included in reusable bag assembly 10 incorporates a handy and organized system of shopping with reusable primary and auxiliary shopping bags. Panel assembly 16 is convenient to use, saves time and effort, and adds to a person's shopping ease and comfort. The compact reusable bag assembly 10 is designed and constructed to provide an easy transition from use of conventional point of sale paper and plastic shopping bags to the use of reusable bags to assist communities to mitigate the use of oil, deforestation, ecological destruction and plastic pollution.

It is to be understood that the above description is intended to be illustrative, not restrictive. Numerous characteristics and advantages of the compact reusable shopping bag assembly materials, sizes and shapes of the shopping bag assembly and shopping bags as described herein have been set forth in the foregoing description together with details of their structure and functions. The scope of the invention should, therefore, be determined with reference to the appended claims, along with the full scope of equivalents to which such claims are entitled.

The invention claimed is:

1. A compact reusable shopping bag assembly comprising: a pocket having a generally flat front wall, a bottom wall and upright side walls joined to the front wall, providing a pocket cavity, an upright partition located in the pocket cavity joined to the bottom and side walls divides the pocket cavity into two compartments, a plurality of folded reusable bags, located in one of said compartments, the other of said compartment being adapted to hold sheet materials and brochures, a first panel having a first cavity for holding printed sheet materials, a second panel comprising a transparent member superimposed over the first panel having a second cavity for holding sheet members with written information and printed sheet materials which are visible through the transparent member, connectors securing the first and second panels to the front wall of the pocket, a member secured to the front wall of the pocket adjacent the first and second panels for releasably holding a writing instrument, a primary bag having a first side wall, a second side wall, end walls, a bottom wall, said bottom wall and upright side walls of the pocket being secured to the first side wall of the primary bag, said bottom wall of the primary bag being hinged to a bottom portion of the first side wall for selected movement between horizontal and upright positions, the second, bottom and end walls of the primary bag being folded in side-by-side positions adjacent the side wall of the primary bag attached to the bottom wall and upright side walls of the pocket, said side wall of the primary bag having a top portion located adjacent the folded second, bottom and end walls of the primary bag, and releasable retainers attached to the end walls of the pocket and the top portion of the first side wall of the primary bag for securing the top portion of the first side wall to side walls of the pocket to hold the first, second, bottom and end walls of the primary bag folded in side-by-side positions adjacent the pocket, said retainers when released allow said first, second, bottom, and end walls of the primary bag to unfold to open the primary bag, and handles attached to the first and second side walls of the primary bag to facilitate manual carrying of the pocket and primary bag.

2. The compact reusable shopping bag assembly of claim 1 including: an elastic band extended across the transparent member for holding a sheet member on top of the transparent member, and connectors securing opposite ends of the band to the front wall of the pocket.

3. The compact reusable shopping bag assembly of claim 1 wherein: the folded reusable bags include a pair of folded secondary bags located in one of said compartments of the pocket cavity of the pocket, and handles secured to the secondary bags to facilitate manual carrying of the secondary bags in their unfolded condition.

4. The reusable shopping bag assembly of claim 3 wherein: each secondary bag has an upright wall when in the unfolded condition, a first panel having a first interior cavity for holding printed matter, a second panel comprising a transparent member superimposed the first panel enclosing a second cavity for holding printed materials which can be viewed through said transparent member, and connectors securing the first and second panels to said upright wall of the secondary bag.

5. The compact reusable shopping bag assembly of claim 4 including: an elastic band extended horizontally across the transparent member for holding and securing a sheet member on top of the transparent member, and connectors securing opposite ends of the band to said upright wall of the secondary bag.

6. The compact reusable shopping bag assembly of claim 3 wherein: the handles secured to one secondary bag are elongated shoulder straps.

7. The compact reusable shopping bag assembly of claim 1 wherein: the folded reusable bags include a plurality of folded reusable bags located in one of said compartments of the pocket cavity of the pocket, one of said shopping bags having a pair of handles extended upward above the top of the pocket cavity usable to manually carry the shopping bag assembly, a flap secured to the pocket extended over the top of the pocket cavity under the handles, and a releasable fastener securing the flap to the partition to contain and secure the folded reusable bags in the one compartment of the pocket cavity, said fastener when released allowing the folded reusable bags to be removed from the one compartment of the pocket cavity.

8. The compact reusable shopping bag assembly of claim 1 wherein: said releasable retainers each include a flexible strap having a first end connected to the top portion of the first side wall of the primary shopping bag and a second end, and a releasable fastener connecting the second end of the strap to one end wall of the pocket.

9. The compact reusable shopping bag assembly of claim 1 wherein: said handles attached to the first and second side walls of the primary bag are located between the first and second side walls when the first, second, third and end walls of the primary bag are folded in side-by-side positions, and a releasable connector on the first and second side walls of the primary bag operable to maintain the handles between the first and second side walls of the primary bag.

10. A compact reusable shopping bag assembly comprising: a pocket having a generally flat front wall, a bottom wall and upright side walls joined to the front wall providing a pocket cavity for holding at least one folded shopping bag, a first panel having a first cavity for holding printed sheet materials, a second panel comprising a transparent member adjacent the first panel having a second cavity for holding sheet members with written information and printed sheet materials which are visible through the transparent member, connectors securing the first and second panels to the front wall of the pocket, an elastic band extended across the pocket for holding a sheet member on top of the pocket, connectors securing the band to the front wall of the pocket, a primary bag having a first side wall, end walls a second side wall, a bottom wall, said bottom wall and upright side walls of the pocket being secured to the first side wall of the primary bag, said bottom wall of the primary bag being hinged to a bottom portion of the first side wall for movement between horizontal and upright positions, the second, bottom and end walls of the primary bag being folded in side-by-side positions adjacent the bottom portion of the first side wall of the bag, said first side wall of the primary bag having a top portion located adjacent the folded second, bottom and end walls of the primary bag, and releasable retainers attached to the side walls of the pocket and top portion of the first side wall of the primary bag, for securing the top portion of the first side wall of the primary bag to the side walls of the pocket to hold the first, second, bottom and end walls of the primary bag folded in side-by-side positions adjacent the pocket, said retainers when released allow said first, second, third and end walls of the primary bag to unfold to open the primary bag, and at least one handle attached to the primary bag to facilitate manual carrying of the pocket and primary bag.

11. The compact reusable shopping bag assembly of claim 10 including: an upright partition located in the pocket cavity dividing the pocket cavity into two compartments.

12. The compact reusable shopping bag assembly of claim 10 including: a flap secured to the primary bag extended over the top of the pocket cavity, and a releasable fastener securing the flap to the front wall of the pocket to retain and secure the folded shopping bag in the pocket cavity, said fastener when released allowing the folded shopping bag to be removed from the pocket cavity.

13. The compact reusable shopping bag assembly of claim 10 wherein: the releasable retainers include releasable hook and loop fasteners operable to hold the first, second, third and end walls of the primary bag folded in side-by-side positions adjacent the pocket.

14. The compact reusable shopping bag assembly of claim 10 wherein: said handle attached to the primary bag is located in the chamber between the first and second side walls of the primary bag when the first, second, third and end walls of the primary bag are folded in side-by-side positions, and a releasable connector on the first and second side walls of the primary bag operable to maintain the handle in the chamber between the first and second side walls of the primary bag.

15. A compact reusable shopping bag assembly comprising: a pocket having a generally flat front wall, providing a pocket cavity for holding at least one folded shopping bag, a bottom wall and upright side walls joined to the front wall, a primary bag having a first side wall, a second side wall, and a bottom wall, said bottom wall and upright side walls of the pocket being secured to a bottom portion of the first side wall of the primary bag, said bottom wall of the primary bag being hinged to the bottom portion of the first side wall of the primary bag for movement between horizontal and upright positions, the second and bottom walls of the primary bag being folded in side-by-side positions adjacent the bottom portion of the first side wall of the primary bag, said first side wall of the primary bag having a top portion located adjacent the folded second and bottom walls of the primary bag, and releasable retainers attached to the pocket and top portion of the first side wall of the primary bag for securing the top portion of the first side wall of the primary bag to the pocket to hold the second and bottom walls of the primary bag folded in side-by-side positions adjacent the lower portion of the first side wall of the primary bag, said retainers when released allow said first, second, and bottom walls of the primary bag to unfold to open the primary bag, and at least one handle attached to the primary bag to facilitate manual carrying of the pocket and primary bag.

16. The compact reusable shopping bag assembly of claim 15 including: an upright partition located in the pocket cavity dividing the pocket cavity into two compartments.

17. The compact reusable shopping bag assembly of claim 15 including: a flap secured to the middle of the first side wall of the primary bag extended over the top of the pocket cavity, and a releasable fastener securing the flap to the front wall of the pocket to retain and secure the folded shopping bag in the pocket cavity, said fastener when released allowing the folded shopping bag to be removed from the pocket cavity.

18. The compact reusable shopping bag assembly of claim 15 wherein: the releasable retainers include releasable hook and loop fasteners operable to hold the first, second, third and end walls of the primary bag folded in side-by-side positions adjacent the pocket.

19. The compact reusable shopping bag assembly of claim 15 wherein: said handle attached to the primary bag is located in the chamber between the first and second side walls of the primary bag when the first, second, third and end walls of the primary bag are folded in side-by-side positions, and a releasable connector on the first and second side walls of the primary bag operable to maintain the handle in the chamber between the first and second side walls of the primary bag.

20. A compact reusable shopping bag assembly comprising: a pocket having a pocket cavity with a top opening for holding at least one folded secondary bag, said pocket including a front wall, a bottom wall and upright side walls connected to the bottom wall and front wall, said front wall, bottom wall and side walls surrounding said pocket cavity, a primary bag having a first wall, a second wall, and a bottom wall, said bottom wall and upright side walls of the pocket being secured to the first wall of the primary bag, said bottom wall of the primary bag being hinged to a bottom portion of the first wall of the primary bag for movement between horizontal and upright positions, the second and bottom walls of the primary bag being folded in side-by-side positions adjacent the bottom portion of the first wall of the primary bag, said first wall of the primary bag having a top portion located adjacent the folded second and bottom walls of the primary bag, and retainers secured to the top portion of the first wall and pocket to hold the second and bottom walls of the primary bag in the folded side-by-side positions, said retainers being releasable whereby the second and bottom walls can be unfolded so that the first wall, second wall, and bottom wall of the primary bag surrounds an open top chamber for holding objects when the bottom wall is in its horizontal position.

21. The compact reusable shopping bag assembly of claim 20 including: an upright partition located in the pocket cavity joined to the bottom wall and side walls dividing the pocket cavity into two compartments.

22. The compact reusable shopping bag assembly of claim 20 including: an upright partition located in the pocket cavity joined to the bottom wall and side walls dividing the pocket cavity into two compartments, a flap joined to the first wall of the primary bag extended over one compartment, and a releasable connector for attaching the flap to the partition.

23. The compact reusable shopping bag assembly of claim 20 including: a panel having upright side edges and a horizontal bottom edge, and connectors securing said side edges and bottom edge to the outside of the front wall of the pocket whereby the panel and front wall provide a cavity for holding printed materials.

24. The compact reusable shopping bag assembly of claim 20 including: a first panel having a first cavity for holding printed materials, a second panel comprising a transparent member located superimposed on the first panel enclosing a second cavity for holding printed material, which can be viewed through the transparent member, and connectors securing the first and second panels to the outside of the front wall of the pocket.

25. The compact reusable shopping bag assembly of claim 24 including: an elastic band extending across the transparent member for holding and securing the sheet member on top of the transparent member, and connectors securing opposite ends of the band to the front wall of the pocket.

26. The compact reusable shopping bag assembly of claim 20 including: upright handles secured to the first and second upright walls of the primary bag for use to manually carry the shopping bag assembly.

27. The compact reusable shopping bag assembly of claim 20 including: a member for holding a writing instrument connected to the front wall of the pocket.

28. The compact reusable shopping bag assembly of claim 20 including: a folded secondary bag located in the pocket cavity of the pocket, said secondary bag having arched handles extended upward above the top of the pocket cavity usable to manually carry the shopping bag assembly, a flap secured to the rear wall of the pocket extended over the top of the pocket cavity under the arched handles, and a releasable fastener securing the flap to the pocket to secure and contain the secondary shopping bag in the pocket, said fasteners when released allowing the secondary shopping bag to be removed from the pocket cavity.

29. The compact reusable shopping bag assembly of claim 20 including: a pair of folded secondary bags located in the pocket cavity of the pocket, and handles secured to the secondary bags to facilitate manual carrying of the secondary bags in their unfolded condition.

30. The compact reusable shopping bag assembly of claim 29 wherein: each secondary bag has an upright wall when in the unfolded condition, a first panel having a first cavity for holding printed matter, a second panel comprising a transparent member superimposed on the first panel enclosing a second cavity for holding printed materials which can be viewed through said transparent member, and connectors securing the first and second panels to said upright wall of the secondary bag.

31. The compact reusable shopping bag assembly of claim 30 including: an elastic band extended horizontally across the transparent member for holding and securing a sheet member on top of the transparent member, and connectors securing opposite ends of the band to said upright wall of the secondary bag.

32. The compact reusable shopping bag assembly of claim 29 wherein: the handles secured to one secondary bag are elongated shoulder straps.

33. The compact reusable shopping bag assembly of claim 29 including: a member for holding a writing instrument, said member having opposite ends, and connectors securing the opposite ends of the members to the upright wall of the secondary bag.

* * * * *